US011242186B2

(12) United States Patent
Nakajima et al.

(10) Patent No.: US 11,242,186 B2
(45) Date of Patent: Feb. 8, 2022

(54) PACKING BODY, METHOD OF MANUFACTURING PACKING BODY, AND METHOD OF MANUFACTURING LIQUID EJECTING APPARATUS

(71) Applicant: SEIKO EPSON CORPORATION, Tokyo (JP)

(72) Inventors: Yoshinori Nakajima, Matsumoto (JP); Shinichi Tokunaga, Gunasahi (JP); Takahiro Kanegae, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 116 days.

(21) Appl. No.: 16/394,840

(22) Filed: Apr. 25, 2019

(65) Prior Publication Data

US 2019/0329959 A1 Oct. 31, 2019

(30) Foreign Application Priority Data

Apr. 25, 2018 (JP) ..... JP2018-083716

(51) Int. Cl.
*B65D 81/26* (2006.01)
*B41J 2/175* (2006.01)

(52) U.S. Cl.
CPC ..... *B65D 81/264* (2013.01); *B41J 2/17533* (2013.01)

(58) Field of Classification Search
CPC ..... B65D 81/264; B65D 81/24; B41J 2/17533
USPC ..... 206/204
See application file for complete search history.

(56) References Cited

U.S. PATENT DOCUMENTS 4,852,732 A * 8/1989 Wilski ..... B65D 81/268 206/204
6,050,400 A * 4/2000 Taskis ..... B65D 77/04 206/204
6,097,407 A * 8/2000 Terasawa ..... B41J 2/16505 206/204
6,283,587 B1 * 9/2001 Umemura ..... B41J 2/17533 347/86
6,308,826 B1 * 10/2001 Merrell ..... B65D 77/04 206/204
6,767,084 B2 7/2004 Moriya et al.
7,513,612 B2 * 4/2009 Takagi ..... B41J 2/17506 347/86
7,694,810 B1 * 4/2010 Barry ..... A61M 25/002 206/364
7,975,842 B2 * 7/2011 Thoes ..... G01N 33/48764 206/204

(Continued)

FOREIGN PATENT DOCUMENTS

CN 105383780 3/2016
JP 2002-331663 A 11/2002

(Continued)

*Primary Examiner* — Steven A. Reynolds
(74) *Attorney, Agent, or Firm* — Workman Nydegger

(57) ABSTRACT

There are included a packing material that has a moisture-proof property and forms a third space, a liquid ejecting head that includes a case member which forms a second space communicating with the third space, and a first moisture absorbing material and a piezoelectric element which are disposed in the second space, and is disposed in the third space, and a second moisture absorbing material that has a higher moisture absorbing property than that of the first moisture absorbing material and is disposed in the third space.

6 Claims, 10 Drawing Sheets

(56) References Cited

U.S. PATENT DOCUMENTS

| | | | | |
|---|---|---|---|---|
| 2002/0130930 | A1 | 9/2002 | Moriya et al. | |
| 2005/0225209 | A1 | 10/2005 | Nakano et al. | |
| 2006/0023009 | A1* | 2/2006 | Tsukada | B41J 2/17523 347/7 |
| 2015/0130876 | A1 | 5/2015 | Nystrom et al. | |
| 2016/0016412 | A1* | 1/2016 | Mizutani | B41J 2/17513 347/86 |
| 2018/0111381 | A1* | 4/2018 | Komplin | B41J 2/17533 |

FOREIGN PATENT DOCUMENTS

| | | | |
|---|---|---|---|
| JP | 4209144 | B | 1/2004 |
| JP | 2015-093488 | A | 5/2015 |

* cited by examiner

PACKING BODY, METHOD OF MANUFACTURING PACKING BODY, AND METHOD OF MANUFACTURING LIQUID EJECTING APPARATUS

The present application is based on, and claims priority from JP Application Serial Number 2018-083716, filed Apr. 25, 2018, the disclosure of which is hereby incorporated by reference herein in its entirety.

BACKGROUND

1. Technical Field

The present disclosure relates to a packing body, a method of manufacturing the packing body, and a method of manufacturing a liquid ejecting apparatus using the packing body.

2. Related Art

An ink jet type recording apparatus (liquid ejecting apparatus) has been proposed in which a piezoelectric element generates a pressure fluctuation in a pressure generating chamber filled with a liquid such as ink, and the liquid is ejected by utilizing the pressure fluctuation (for example, JP-A-2002-331663).

For example, in a liquid ejecting head of the liquid ejecting apparatus described in JP-A-2002-331663, the piezoelectric element is sealed in a space to the extent that motion is not hindered by a reservoir forming substrate, and is isolated from an outside air.

Furthermore, a sealing member on which a moisture absorbing material is disposed is detachably fixed to the reservoir forming substrate, and an increase in humidity in a space where the piezoelectric element is accommodated is prevented by the moisture absorbing material.

Since the liquid ejecting head has a complicated liquid flow path through which the liquid flows, there is a possibility that a test solution used when inspecting a performance of the liquid ejecting head remains in the liquid flow path. Furthermore, as the liquid ejecting head is densified, the liquid flow path is fine and complicated, and the test solution is likely to remain in the liquid flow path.

Therefore, in the liquid ejecting apparatus described in JP-A-2002-331663, when the sealing member on which the moisture absorbing material is disposed is fixed to the reservoir forming substrate, there is a problem that the moisture absorbing material absorbs the moisture of the test solution remaining in the liquid flow path, and the performance of the moisture absorbing material (moisture absorbing property) decreases. Furthermore, in addition to the presence or absence of introduction of the test solution, when the sealing member on which the moisture absorbing material is disposed is fixed to the reservoir forming substrate, the moisture absorbing material is exposed to the outside air. Therefore, there is also a problem that the moisture absorbing material absorbs moisture contained in the outside air and the moisture absorbing property of the moisture absorbing material decreases.

SUMMARY

According to an aspect of the present disclosure, there is provided a packing body including a packing material that has a moisture-proof property and forms a packing space, a liquid ejecting head that includes a space forming member which forms an accommodating space communicating with the packing space, and a first moisture absorbing material and an electronic component which are disposed in the accommodating space, and is disposed in the packing space, and a second moisture absorbing material that has a higher moisture absorbing property than that of the first moisture absorbing material and is disposed in the packing space.

In the packing body, the space forming member may include an atmosphere communication port that allows the accommodating space and the packing space to communicate with each other, and the electronic component may be a piezoelectric element.

In the packing body, the first moisture absorbing material may be a physical adsorption-type moisture absorbing material.

In the packing body, the second moisture absorbing material may be a chemical reaction-type moisture absorbing material.

In the packing body, a maximum amount of moisture absorption of the second moisture absorbing material may be greater than a maximum amount of moisture absorption of the first moisture absorbing material.

In the packing body, the liquid ejecting head may be accommodated in a case having moisture permeability.

According to another aspect of the present disclosure, there is provided a method of manufacturing a packing body including disposing a liquid ejecting head in which a first moisture absorbing material and an electronic component are disposed in an accommodating space formed by a space forming member, and a second moisture absorbing material having a higher moisture absorbing property than that of the first moisture absorbing material in a packing space formed by a packing material having a moisture-proof property in a state where the accommodating space and the packing space communicate with each other, and sealing the packing material.

In the method of manufacturing the packing body, a maximum amount of moisture absorption of the second moisture absorbing material may be greater than a maximum amount of moisture absorption of the first moisture absorbing material.

The method of manufacturing the packing body may further include storing the packing body for a predetermined time after the sealing.

According to still another aspect of the present disclosure, there is provided a method of manufacturing a liquid ejecting apparatus using a liquid ejecting head disposed in a packing space formed by a packing body having a moisture-proof property, in which the liquid ejecting head includes a space forming member which forms an accommodating space communicating with the packing space, and a first moisture absorbing material and an electronic component which are disposed in the accommodating space, and the liquid ejecting head and a second moisture absorbing material that has a higher moisture absorbing property than that of the first moisture absorbing material are disposed in the packing space, the method including taking out the liquid ejecting head from the packing body, and fixing the liquid ejecting head to a carriage provided in the liquid ejecting apparatus.

In the method of manufacturing the liquid ejecting apparatus, a predetermined time for moving moisture from the first moisture absorbing material to the second moisture absorbing material may be provided before the taking out of the liquid ejecting head from the packing body.

DESCRIPTION OF EXEMPLARY EMBODIMENTS

Figure 1:
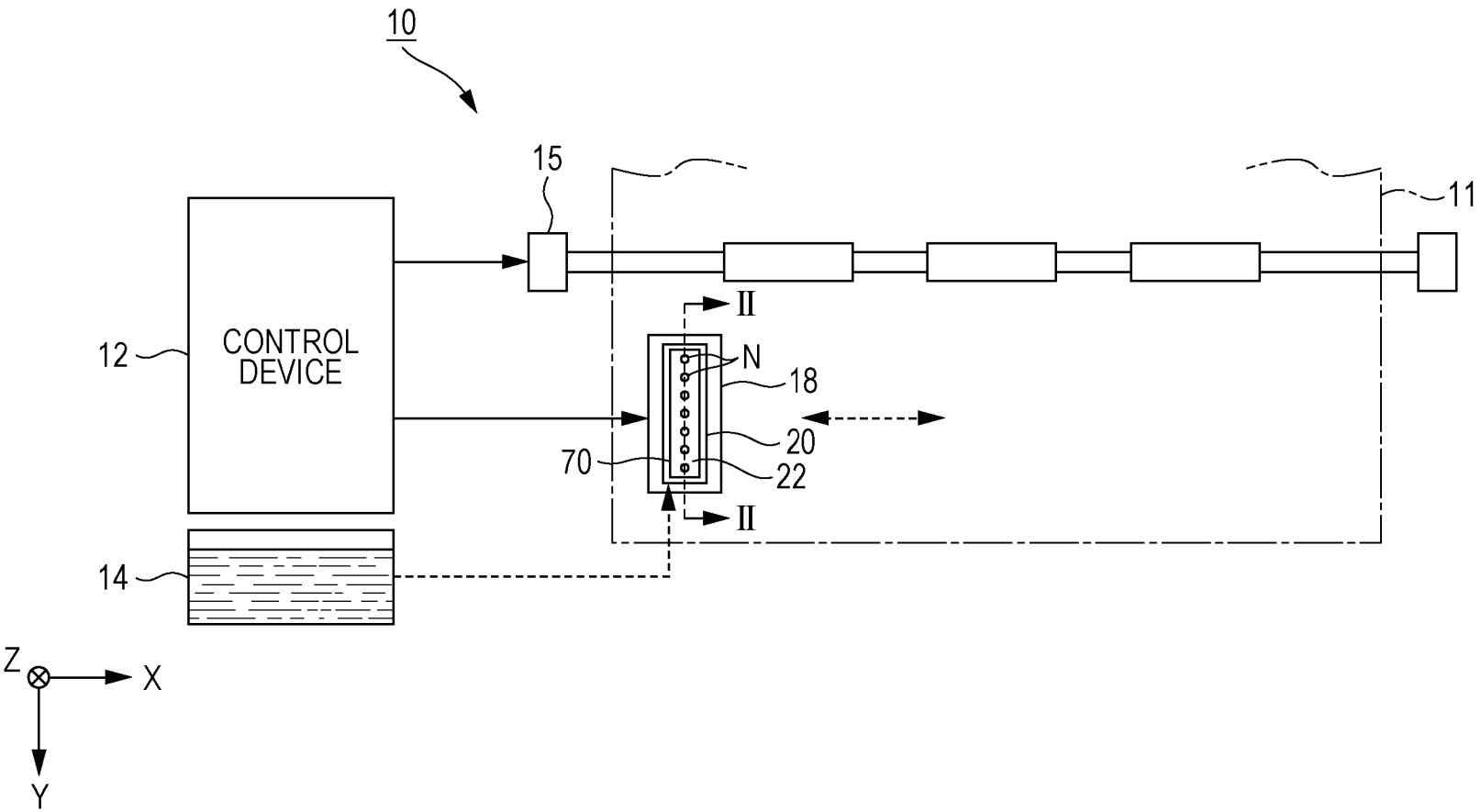
FIG. 1 is a partial configuration diagram of a liquid ejecting apparatus according to Embodiment 1.

Hereinafter, embodiments of the present disclosure will be described with reference to the drawings. Such an embodiment describes one embodiment of the present disclosure, does not limit the present disclosure, and can be arbitrarily changed within the scope of the technical idea of the present disclosure. In addition, in each of the following drawings, the scale of each layer and each part is made different from the actual scale in order to make each layer and each part size recognizable on the drawing.

Embodiment 1

Outline of Liquid Ejecting Apparatus

Figure 2:
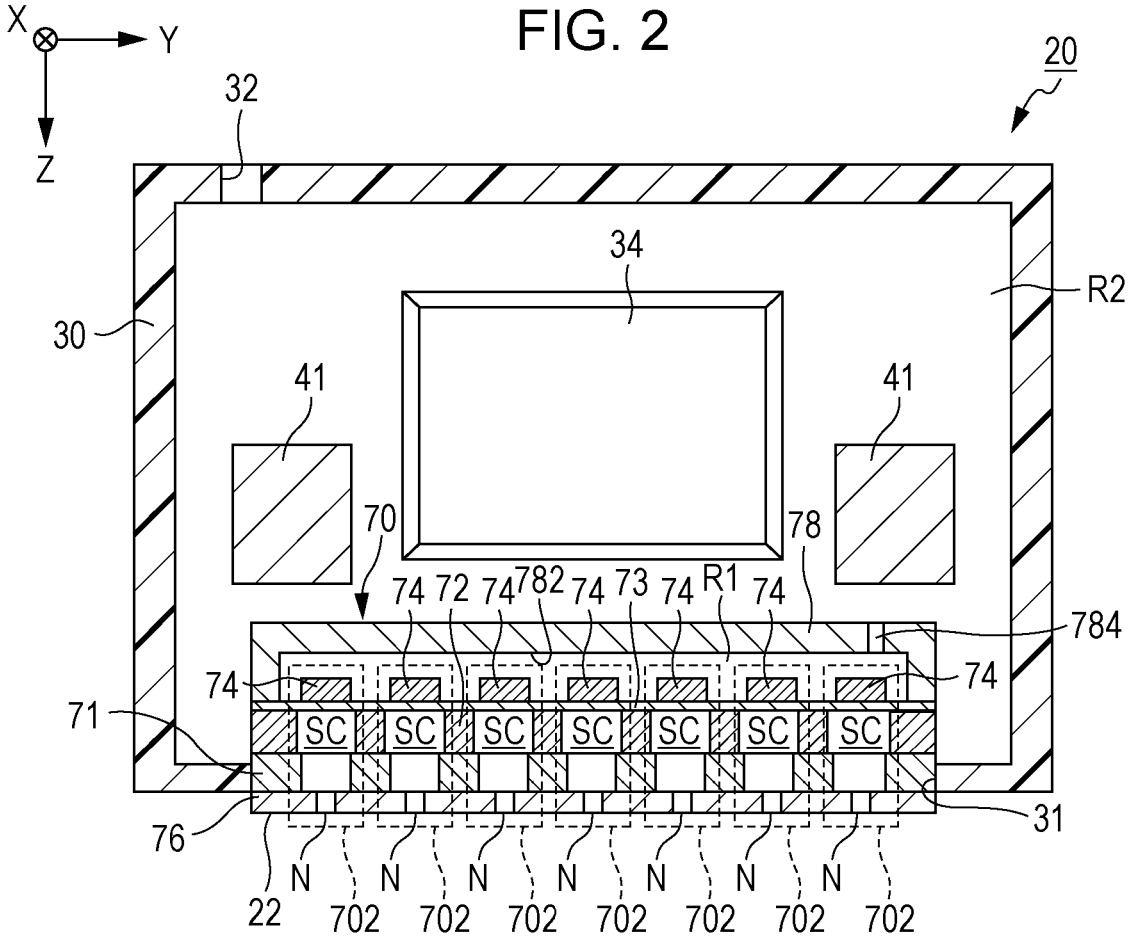
FIG. 2 is a schematic cross-sectional view of a liquid ejecting head.
Figure 3:
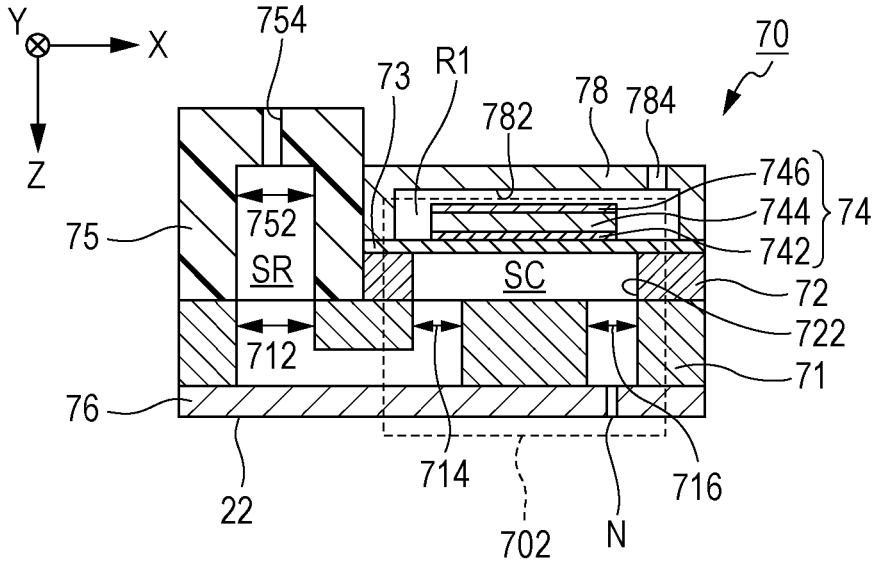
FIG. 3 is a schematic cross-sectional view of a liquid ejecting portion.

FIG. 1 is a partial configuration diagram of a liquid ejecting apparatus according to Embodiment 1. FIG. 2 is a schematic cross-sectional view of a liquid ejecting head, and illustrates a cross section taken along line II-II of the liquid ejecting head 20 illustrated in FIG. 1. FIG. 3 is a schematic cross-sectional view of a liquid ejecting portion.

FIG. 3 is a cross-sectional view of the liquid ejecting portion 70 focusing on one predetermined ejecting portion 702 among a plurality of ejecting portions 702 provided in a liquid ejecting portion 70.

First, with reference to FIG. 1, the outline of the liquid ejecting apparatus 10 according to the embodiment will be described.

The liquid ejecting apparatus 10 according to the embodiment is an ink jet type printing apparatus that ejects ink onto a medium 11 such as printing paper to form a desired image on the medium 11.

As illustrated in FIG. 1, the liquid ejecting apparatus 10 according to the present embodiment includes a control device 12, a transport mechanism 15, a carriage 18, and a liquid ejecting head 20. A liquid container 14 for storing ink is mounted on the liquid ejecting apparatus 10.

The liquid container 14 is an ink tank type cartridge made of a box-shaped container detachable from the main body of the liquid ejecting apparatus 10. The liquid container 14 is not limited to a box-shaped container, and may be an ink pack type cartridge made of a bag-shaped container. In the liquid container 14, ink is stored. The ink may be black ink or color ink. The ink stored in the liquid container 14 is pressure-fed to the liquid ejecting head 20.

The control device 12 comprehensively controls each component of the liquid ejecting apparatus 10. The transport mechanism 15 transports the medium 11 in the Y direction under the control of the control device 12. The liquid ejecting head 20 ejects the ink supplied from the liquid container 14 to the medium 11 from each of a plurality of nozzles N under the control of the control device 12.

In the following description, the direction in which the medium 11 is transported is defined as the Y direction, the width direction of the medium 11 intersecting the Y direction is defined as the X direction, and the height direction of the liquid ejecting apparatus 10 is defined as the Z direction. In addition, a tip end side of an arrow indicating the direction is the (+) direction, and a base end side of the arrow indicating the direction is the (−) direction.

The Z direction is a vertical direction, and the X-Y plane is a horizontal plane.

The liquid ejecting head 20 is mounted on the carriage 18. In FIG. 1, although a case in which one liquid ejecting head 20 is mounted on the carriage 18 is exemplified, the disclosure is not limited thereto, and a plurality of liquid ejecting heads 20 may be mounted on the carriage 18.

The control device 12 reciprocates the carriage 18 in the X direction. By repeating the operation of transporting the medium 11 in the Y direction and the operation of ejecting ink onto the medium 11 while the liquid ejecting head 20 mounted on the carriage 18 moves in the X direction, a desired image is formed on the medium 11. The liquid ejecting head 20 is a serial head that ejects ink while being mounted on the carriage 18 and moving in the X direction, and the liquid ejecting head 20 may be a line head that is disposed to extend in the X direction (width direction of medium 11) in a fixed state.

The liquid ejecting head 20 has a liquid ejecting portion 70. In the liquid ejecting portion 70, nozzle rows are arranged. The nozzle row is a group of the plurality of nozzles N linearly arranged along the Y direction. From each nozzle N, ink supplied from the liquid container 14 is ejected. The nozzles N of each nozzle row are formed on an ejecting surface 22 (surface facing medium 11) of the liquid ejecting head 20. The number and arrangement of the liquid ejecting portion 70 and the nozzle row are not limited to those exemplified. For example, it is possible to arrange the plurality of nozzle rows in a zigzag or staggered shape on the ejecting surface 22 of the liquid ejecting head 20.

As illustrated in FIG. 2, the liquid ejecting head 20 includes a liquid ejecting portion 70 and a case member 30.

The case member 30 is a member having a space (second space R2) inside. In other words, the case member 30 is a member that forms the second space R2. The case member 30 is made of synthetic resin or metal, for example. The case member 30 may be formed by adhering, welding, or fixing by screws a plurality of members. An opening portion 31 is formed on the Z (+) direction side of the case member 30, and the liquid ejecting portion 70 is fixed to the case member 30 so that the ejecting surface 22 of the liquid ejecting portion 70 is exposed from the opening portion 31. That is, the liquid ejecting portion 70 is accommodated in the second space R2 formed by the case member 30 so that the ejecting surface 22 of the liquid ejecting portion 70 is exposed from the opening portion 31.

Furthermore, on the surface on the Z (−) direction side of the case member 30, an atmosphere communication port 32 that communicates the second space R2 and the outside (for example, atmosphere, third space R3 (refer to FIG. 4), and the like) is provided.

The case member 30 is an example of the "space forming member", and the second space R2 formed by the case member 30 is an example of "accommodating space".

As illustrated in FIG. 3, the liquid ejecting portion 70 is a structure body in which a pressure chamber substrate 72, a vibration plate 73, a piezoelectric element 74, and a support body 75 are disposed on one side of the flow path substrate 71, and a nozzle plate 76 is disposed on the other side of the flow path substrate 71. The flow path substrate 71, the pressure chamber substrate 72, and the nozzle plate 76 are formed of, for example, a flat plate material (silicon substrate) of silicon, and the support body 75 is formed by injection molding of a resin material, for example. The plurality of nozzles N are formed in the nozzle plate 76. The surface of the nozzle plate 76 facing the medium 11 forms the ejecting surface 22 of the liquid ejecting head 20.

The pressure chamber substrate 72 and the vibration plate 73 may be integrally provided as in a case in which a portion of the members forming the pressure chamber substrate 72 is thinned to function as the vibration plate 73.

On the flow path substrate 71, an opening portion 712, a branch flow path 714, and a communication flow path 716 are formed. The branch flow path 714 and the communication flow path 716 are through-holes formed for each nozzle N. The opening portion 712 is a continuous opening portion over the plurality of nozzles N. A space where an accommodating portion 752 (recessed portion) formed in the support body 75 and the opening portion 712 of the flow path substrate 71 communicate with each other functions as a common liquid chamber SR (reservoir) that stores ink supplied from the liquid container 14 via an introduction flow path 754 of the support body 75.

An opening portion 722 is formed for each nozzle N on the pressure chamber substrate 72. The vibration plate 73 is an elastically deformable flat plate material disposed on the surface of the pressure chamber substrate 72 opposite to the flow path substrate 71. A space interposed between the vibration plate 73 and the flow path substrate 71 inside each opening portion 722 of the pressure chamber substrate 72 functions as a pressure chamber SC (cavity) filled with ink supplied from the common liquid chamber SR via the branch flow path 714. Each of the pressure chambers SC communicates with the nozzle N via the communication flow path 716 of the flow path substrate 71.

On the surface of the vibration plate 73 opposite to the pressure chamber substrate 72, the piezoelectric element 74 is formed for each nozzle N. Each piezoelectric element 74 is a driving element in which a piezoelectric body 744 is interposed between a first electrode 742 and a second electrode 746. A driving signal is supplied to one of the first electrode 742 and the second electrode 746, and a predetermined reference potential is supplied to the other. When the vibration plate 73 vibrates due to the deformation of the piezoelectric element 74 by the supply of the drive signal, the pressure in the pressure chamber SC varies, and the ink in the pressure chamber SC is ejected from the nozzle N. Specifically, ink of an ejection amount corresponding to the amplitude of the drive signal is ejected from the nozzle N. One ejecting portion 702 illustrated in FIG. 3 is a portion that includes the piezoelectric element 74, the vibration plate 73, the pressure chamber SC, and the nozzle N.

As illustrated in FIGS. 2 and 3, in order to protect the piezoelectric element 74 and the vibration plate 73 from moisture, the piezoelectric element 74 and the vibration plate 73 are accommodated in a first space R1 formed by a sealing body 78. In addition, the first space R1 is accommodated in the second space R2 formed by the case member 30. Furthermore, a communication hole 784 for communicating the first space R1 with the second space R2 is formed on the Z (−) direction side surface of the sealing body 78.

The sealing body 78 is a plate member having a recessed portion 782 formed on the surface on the Z (+) direction side, and is joined to the vibration plate 73 with an adhesive or the like to form the first space R1 with the vibration plate 73. That is, the first space R1 is a space surrounded by the recessed portion 782 of the sealing body 78 and the vibration plate 73.

Incidentally, when the first space R1 accommodating the piezoelectric element 74 and the vibration plate 73 is in communication with the atmosphere, moisture is likely to enter the first space R1. When moisture enters the first space R1 and the piezoelectric element 74 is exposed to a high humidity environment for a long period of time, there is a possibility that the first electrode 742 and the second electrode 746 of the piezoelectric element 74 corrode or the strength decreases due to hydrolysis and cracks occur. Furthermore, also in the vibration plate 73, when the vibration plate 73 is exposed to a high humidity environment for a long period of time, there is a possibility that the strength decreases due to hydrolysis and cracks occur.

Furthermore, when the first space R1 is made a sealed space that is not communicated with the atmosphere so that moisture does not enter the first space R1, the vibration of the pressure chamber SC due to the driving of the piezoelectric element 74 propagates to the first space R1, and pressure fluctuation also occurs in the first space R1. Since each of the pressure chambers SC is also affected by the pressure fluctuation in the first space R1, there is a possibility that the ejection characteristics are changed by the pressure variation in the first space R1 due to such structural crosstalk. In addition, since the pressure fluctuation in the first space R1 also changes depending on the number of the piezoelectric elements 74 to be driven, a large difference in pressure fluctuation occurs. Therefore, there is a possibility that the ejection characteristics are changed depending on the number of piezoelectric elements 74 to be driven.

Therefore, in the present embodiment, as illustrated in FIG. 2, the atmosphere communication port 32 communicating the second space R2 with the atmosphere is formed in the case member 30 and the communication hole 784 communicating the first space R1 with the second space R2 is formed in the sealing body 78. In addition, a first moisture absorbing material 41 is disposed in the second space R2.

With this configuration, even when moisture enters the second space R2 from the atmosphere communication port 32, moisture is absorbed by the first moisture absorbing material 41 in the second space R2. Therefore, moisture entering the first space R1 through the communication hole 784 can be reduced, so that the liquid ejecting portion 70 (piezoelectric element 74 and vibration plate 73) can be protected from moisture. Accordingly, it is possible to protect the piezoelectric element 74 and the vibration plate 73 from moisture while suppressing the pressure fluctuation of the first space R1 accommodating the piezoelectric element 74.

Furthermore, in addition to the liquid ejecting portion 70, a circuit substrate 34 for driving the piezoelectric element 74 is disposed in the second space R2 formed by the case member 30. As a result, the circuit substrate 34 is protected from moisture in addition to the liquid ejecting portion 70 (piezoelectric element 74 and vibration plate 73).

In the liquid ejecting head 20, the first space R1 communicates with the second space R2 via the communication hole 784 and is disposed in the second space R2. Therefore, the piezoelectric element 74 and the vibration plate 73 disposed in the first space R1 can be regarded as disposed in the second space R2, similarly to the circuit substrate 34 and the first moisture absorbing material 41.

That is, the liquid ejecting head 20 has a configuration in which the first moisture absorbing material 41, the piezoelectric element 74, and the circuit substrate 34 are disposed in the second space R2. In this manner, the liquid ejecting head 20 has the case member 30 forming the second space R2, the first moisture absorbing material 41, the piezoelectric element 74, and the circuit substrate 34 disposed in the second space R2.

The piezoelectric element 74 and the circuit substrate 34 are examples of "electronic components".

Outline of Packing Body

Figure 4:
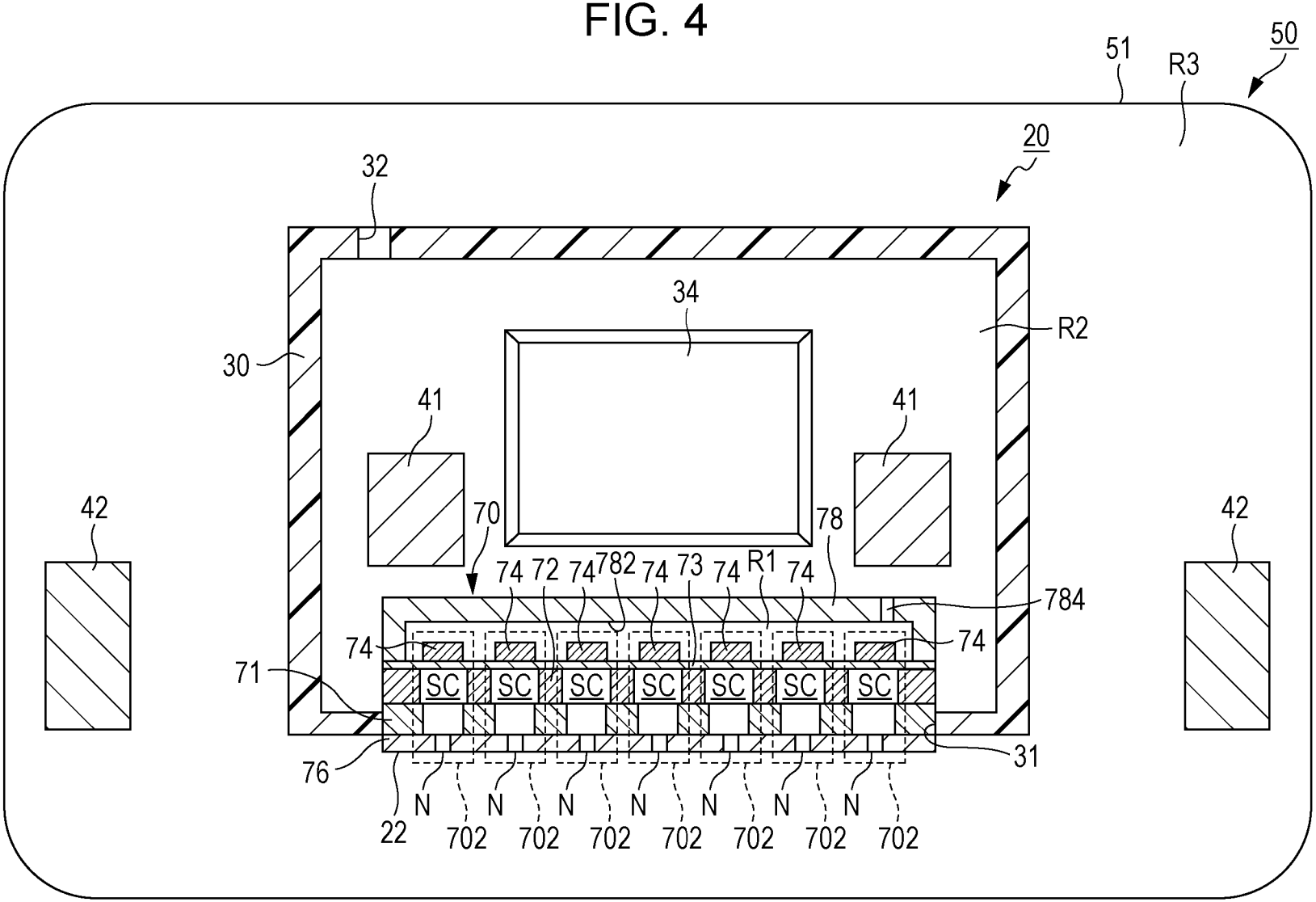
FIG. 4 is a schematic cross-sectional view of a packing body according to the embodiment.
Figure 5:
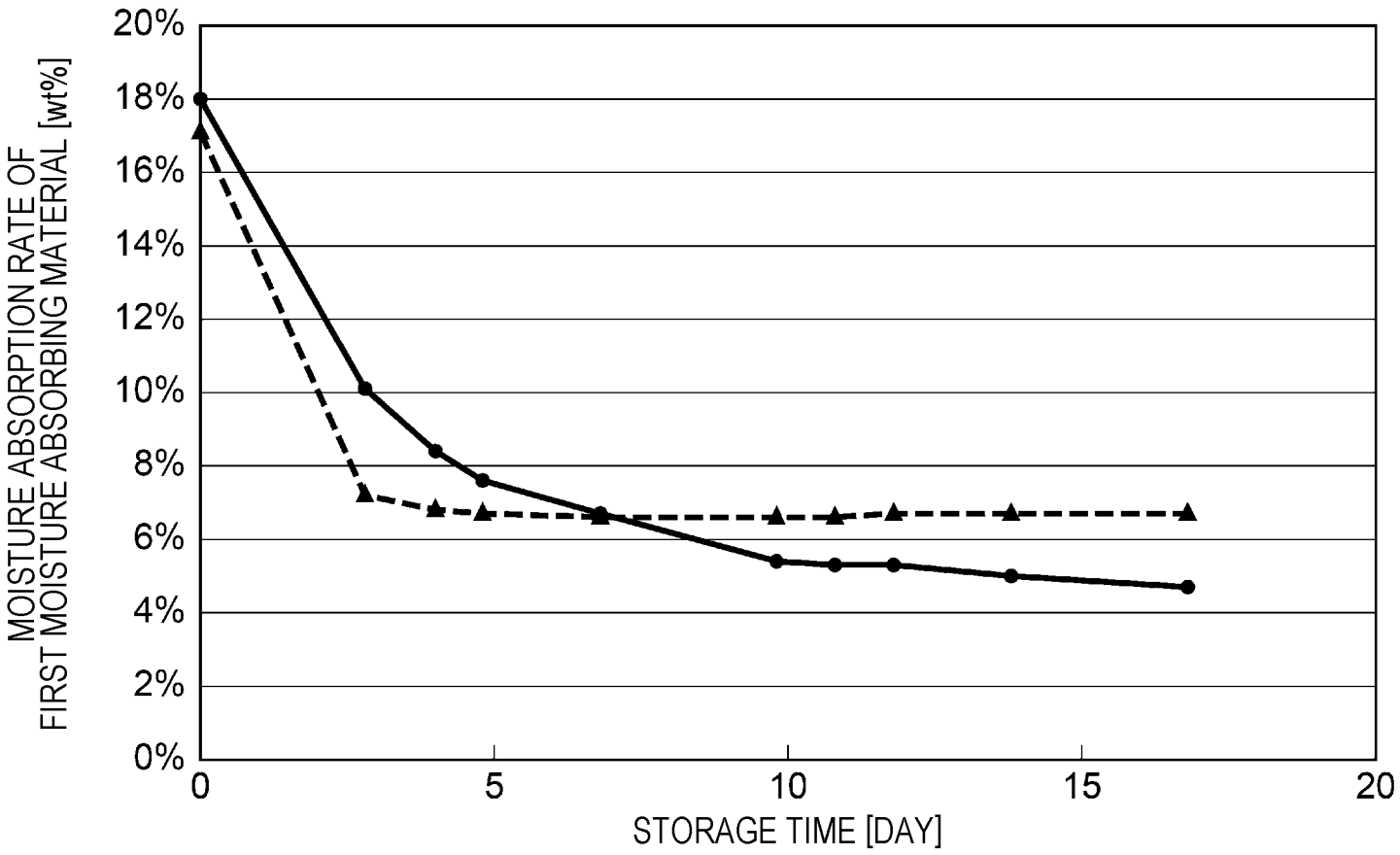
FIG. 5 is a graph illustrating a relationship between a storage time of the packing body and a moisture absorption rate of a first moisture absorbing material.

FIG. 4 is a schematic cross-sectional view of a packing body according to the embodiment. FIG. 5 is a graph illustrating a relationship between a storage time of the packing body and a moisture absorption rate of a first moisture absorbing material.

Next, with reference to FIGS. 4 and 5, the outline of the packing body 50 according to the embodiment will be described.

As illustrated in FIG. 4, the packing body 50 according to the embodiment includes a packing material 51 forming a third space R3 which is an example of the "packing space", the liquid ejecting head 20, a second moisture absorbing material 42.

The packing material 51 is formed of a vapor-deposited metal film on which a metal such as aluminum is vapor-deposited, and has a moisture-proof property in addition to gas barrier properties. The constituent material of the packing material 51 may have the moisture-proof property, and in addition to the vapor-deposited metal film, a metal foil laminated film obtained by laminating a metal foil such as an aluminum foil and a substrate film, a film coated with an organic or inorganic barrier coating agent (coated film) or the like can be used. In addition, the packing material may be a sealed container made of metal.

The first moisture absorbing material 41 disposed in the second space R2 of the liquid ejecting head 20 is a physical adsorption-type moisture absorbing material and is formed of a clay semi-mineral (allophane) which is amorphous or formed of hydrated aluminum silicate having a low crystallinity. As an example, the first moisture absorbing material 41 is a molded product formed by molding a mixture of allophane and a resin (for example, polyethylene).

In the first moisture absorbing material 41 which is the physical adsorption-type moisture absorbing material, adsorption of moisture and release of moisture are performed reversibly, and moisture once absorbed can be released. Therefore, even when the first moisture absorbing material 41 absorbs moisture and the moisture absorbing property of the first moisture absorbing material 41 decreases, for example, by releasing moisture from the first moisture absorbing material 41 by heating or storing in a dry atmosphere for a long time, it is possible to recover the moisture absorbing property of the first moisture absorbing material 41.

The second moisture absorbing material 42 disposed in the third space R3 formed by the packing material 51 is a chemical reaction-type moisture absorbing material, and calcium oxide, calcium chloride, hydrated lime, or the like can be used. Specifically, the second moisture absorbing material 42 is formed of calcium oxide and a film containing calcium oxide and having moisture permeability. Since the second moisture absorbing material 42 which is the chemical reaction-type moisture absorbing material absorbs moisture by a chemical reaction, the second moisture absorbing material 42 has a higher moisture absorbing property than that of the first moisture absorbing material 41 which physically adsorb moisture, especially in a low humidity environment, and is likely to absorb moisture.

For example, under the condition that the weights of the moisture absorbing materials 41 and 42 are the same as each other, the amount of moisture absorbed by the second moisture absorbing material 42 per unit time in a low humidity environment (for example, environment with relative humidity of 10%) is greater than the amount of water absorbed by the first moisture absorbing material 41 per unit time in a low humidity environment. In such a case, the second moisture absorbing material 42 has the higher moisture absorbing property than that of the first moisture absorbing material 41. That is, the fact that has high moisture absorbing property means to have the property of easily absorbing moisture in a low humidity environment (for example, environment with relative humidity of 10%), and the amount of moisture absorbed per unit weight and unit time increases in a low humidity environment. In this manner, the second moisture absorbing material 42 is likely to absorb moisture more than the first moisture absorbing material 41 in a low humidity environment (for example, environment with relative humidity of 10%).

The second moisture absorbing material 42 may have the higher moisture absorbing property than that of the first moisture absorbing material 41, and when the first moisture absorbing material 41 is the physical adsorption-type moisture absorbing material formed of allophane, a physical adsorption-type moisture absorbing material such as silica gel or zeolite can be used as the second moisture absorbing material 42. That is, when the first moisture absorbing material 41 is the physical adsorption-type moisture absorbing material formed of allophane, the second moisture absorbing material 42 may be the chemical reaction-type moisture absorbing material such as calcium oxide, calcium chloride, slaked lime or the like, or may be the physical adsorption-type moisture absorbing material such as silica gel or zeolite.

In the packing body 50, the second moisture absorbing material 42 and the liquid ejecting head 20 are disposed in the third space R3 formed by the packing material 51. Since the packing material 51 has the moisture-proof property, the third space R3 formed by the packing material 51 is unlikely to be affected by external moisture and is a sealed space isolated from outside moisture.

In the packing body 50, since the second space R2 is disposed in the third space R3 and communicates with the third space R3 via the atmosphere communication port 32, the first moisture absorbing material 41 and the electronic components (piezoelectric element 74 and circuit substrate 34) disposed in the second space R2 can be regarded as being disposed in the third space R3 similarly to the second moisture absorbing material 42.

In this manner, in the packing body 50, the first moisture absorbing material 41, the second moisture absorbing material 42, and the electronic components (piezoelectric element 74 and circuit substrate 34) are disposed in the third space R3. In other words, in the packing body 50, the first moisture absorbing material 41, the second moisture absorbing material 42, and the electronic components (piezoelectric element 74 and circuit substrate 34) are disposed in the sealed space isolated from the outside moisture.

The "accommodating space (second space R2) communicating with the "packing space (third space R3)" in the present application means that the third space R3 and the second space R2 are connected to each other so that water (moisture) can move between the third space R3 and the second space R2.

For example, when the atmosphere communication port 32 is provided in the case member 30, since moisture can move between the third space R3 and the second space R2 via the atmosphere communication port 32, the third space R3 and the second space R2 are communicated with each other. For example, when the case member 30 is made of a moisture permeable member (for example, resin) and has the moisture permeability, moisture can move between the third space R3 and the second space R2 via the case member 30 having the moisture permeability without providing the atmosphere communication port 32. Therefore, when the case member 30 has the moisture permeability, the third space R3 and the second space R2 are communicated with each other without providing the atmosphere communication port 32.

That is, in order to communicate the third space R3 and the second space R2, the atmosphere communication port 32 may be provided, or the case member 30 may be formed of a moisture permeable member without providing the atmosphere communication port 32.

From the viewpoint of stabilizing the ejection performance of the densified liquid ejecting head 20, it is preferable to provide the atmosphere communication port 32.

FIG. 5 is a graph illustrating a temporal change in moisture absorption rate of the first moisture absorbing material 41 when the first moisture absorbing material 41 and the second moisture absorbing material 42 are disposed in the sealed space isolated from the outside moisture. The vertical axis in FIG. 5 is the moisture absorption rate of the first moisture absorbing material 41, and the horizontal axis in FIG. 5 is the time during which the first moisture absorbing material 41 and the second moisture absorbing material 42 are stored in the sealed space.

The moisture absorption rate of the first moisture absorbing material 41 is expressed by Following Formula (1).

$$\text{Moisture absorption rate of first moisture absorbing material 41} = (W1 - W0)/W0 \quad (1)$$

Here, W1 is a weight of the first moisture absorbing material 41 when the first moisture absorbing material 41 and the second moisture absorbing material 42 are stored in the sealed space for a predetermined storage time. W0 is a weight of the initial first moisture absorbing material 41 (weight of first moisture absorbing material 41 when prescribed storage time is zero).

As described in the formula (1), the moisture absorption rate of the first moisture absorbing material 41 is calculated by dividing the weight of the first moisture absorbing material 41 changed when the first moisture absorbing material 41 and the second moisture absorbing material 42 are stored in the sealed space for a predetermined storage time by the initial weight of the first moisture absorbing material 41.

The maximum moisture absorption rate of allophane which is a constituent material of the first moisture absorbing material 41 is approximately 22%. In FIG. 5, allophane which has absorbed moisture of approximately 82% of the maximum absorbable moisture, that is, allophane having a moisture absorption rate of 18% by weight is used as the initial first moisture absorbing material 41. When the allophane (first moisture absorbing material 41) having the moisture absorption rate of 18% by weight and the second moisture absorbing material 42 are stored for a predetermined storage time in the sealed space isolated from the outside moisture, the temporal change in the moisture absorption rate of the first moisture absorbing material 41 is illustrated in FIG. 5. Furthermore, a solid line in FIG. 5 illustrates a temporal change in the moisture absorption rate of the first moisture absorbing material 41 when the second moisture absorbing material 42 is calcium oxide. A broken line in FIG. 5 illustrates a temporal change in the moisture absorption rate of the first moisture absorbing material 41 when the second moisture absorbing material 42 is silica gel.

In addition, in FIG. 5, a state where the moisture absorption rate of the first moisture absorbing material 41 increases is a state where the first moisture absorbing material 41 absorbs moisture. In FIG. 5, a state where the moisture absorption rate of the first moisture absorbing material 41 decreases is a state where moisture is lost from the first moisture absorbing material 41.

As illustrated in FIG. 5, the moisture absorption rate of the first moisture absorbing material 41 decreases with the elapse of the storage time both in a case in which the second moisture absorbing material 42 is calcium oxide and a case in which the second moisture absorbing material 42 is silica gel.

When the first moisture absorbing material 41 and the second moisture absorbing material 42 are stored in the sealed space isolated from the outside moisture, the sealed space is in a low humidity environment. In the low humidity environment, since the second moisture absorbing material 42 is likely to absorb moisture more than the first moisture absorbing material 41, it is considered that moisture moves from the first moisture absorbing material 41 to the second moisture absorbing material 42, moisture is lost from the first moisture absorbing material 41, and the moisture absorption rate of the first moisture absorbing material 41 decreases. Furthermore, when moisture is lost from the first moisture absorbing material 41, the moisture absorbing capacity of the first moisture absorbing material 41 is enhanced.

Therefore, when the first moisture absorbing material 41 absorbs moisture and the moisture absorbing property of the first moisture absorbing material 41 decreases, and in a case in which the first moisture absorbing material 41 and the second moisture absorbing material 42 having the higher moisture absorbing property than that of the first moisture absorbing material 41 are disposed in the sealed space isolated from the outside moisture, moisture is moved from the first moisture absorbing material 41 to the second moisture absorbing material 42 to release moisture from the first moisture absorbing material 41 and to recover the moisture absorbing property of the first moisture absorbing material 41, so that the moisture absorbing capacity of the first moisture absorbing material 41 can be enhanced.

In addition, a chemical reaction-type moisture absorbing material formed of calcium oxide, calcium chloride, slaked lime, or the like has the higher moisture absorbing property than that of a physical adsorption-type moisture absorbing material formed of silica gel, zeolite, or the like. Therefore, when using the second moisture absorbing material 42 formed of calcium oxide illustrated by the solid line in FIG. 5, as compared with a case of using the second moisture absorbing material 42 formed of silica gel illustrated by the broken line in FIG. 5, the moisture absorption rate of the first moisture absorbing material 41 is significantly decreased, more moisture is released from the first moisture absorbing material 41, and the moisture absorbing capacity of the first moisture absorbing material 41 is further enhanced.

Therefore, in order to recover the moisture absorbing property of the first moisture absorbing material 41, it is preferable that the moisture absorbing property of the second moisture absorbing material 42 is high, and the second moisture absorbing material 42 is a chemical reaction-type moisture absorbing material formed of calcium oxide, calcium chloride, hydrated lime, and the like.

Therefore, in the packing body 50, since the first moisture absorbing material 41, the second moisture absorbing material 42 having the higher moisture absorbing property than that of the first moisture absorbing material 41, and the electronic components (piezoelectric element 74 and circuit substrate 34) are disposed in the sealed space isolated from the outside moisture, when the first moisture absorbing material 41 absorbs moisture and the moisture absorbing property of the first moisture absorbing material 41 decreases, moisture is moved from the first moisture absorbing material 41 to the second moisture absorbing material 42 to release moisture from the first moisture absorbing material 41 and to recover the moisture absorbing property of the first moisture absorbing material 41, so that the moisture absorbing capacity of the first moisture absorbing material 41 can be enhanced.

Furthermore, in the packing body 50, in order to recover the moisture absorbing property of the first moisture absorbing material 41 and to enhance the moisture absorbing capacity of the first moisture absorbing material 41, it is preferable that the second moisture absorbing material 42 is the chemical reaction-type moisture absorbing material rather than the physical adsorption-type moisture absorbing material.

It is a preferred embodiment of the present disclosure to use the physical adsorption type as the first moisture absorbing material 41 and the chemical reaction type as the second moisture absorbing material 42. First, by using the physical adsorption type that does not cause a chemical reaction as the first moisture absorbing material 41 at a position close to the electronic component in the liquid ejecting head 20, there is an advantage that damage or deterioration of the electronic component due to outgas accompanying the chemical reaction does not occur. Next, since the first moisture absorbing material 41 is close to the ink flow path and is exposed to the atmosphere during an assembly step, a portion of the moisture absorption performance is lost after being assembled in the liquid ejecting head 20 and undergoing an inspection step. By using the physical adsorption type having a characteristic of releasing moisture under drying conditions as the first moisture absorbing material 41, it is possible to recover the moisture absorbing performance by being placed in a dry atmosphere expressed by the second moisture absorbing material 42 thereafter, and there is an advantage that the loss of moisture absorption performance of the first moisture absorbing material 41 can be reduced when taken out from the packing. Furthermore, by using the chemical reaction type as the second moisture absorbing material 42, since the inside of the packing material 51 can be kept at a low humidity as compared with the physical adsorption type, the recoverability of the moisture absorption performance of the first moisture absorbing material 41 is improved. On the other hand, since the second moisture absorbing material 42 is the chemical reaction type, even when a corrosive reaction gas of an electronic component comes out, when the first moisture absorbing material 41 is the physical adsorptive type, since the first moisture absorbing material 41 also has a side surface that adsorbs the reaction gas, it has a special effect that damage and deterioration of electronic component can be prevented.

Furthermore, in the packing body 50, when the maximum amount of moisture absorption of the second moisture absorbing material 42 is smaller than the maximum amount of moisture absorption of the first moisture absorbing material 41, the amount of moisture moving from the first moisture absorbing material 41 to the second moisture absorbing material 42 decreases and there is a possibility that the moisture absorbing capacity of the first moisture absorbing material 41 is unlikely to be enhanced.

In the packing body 50, when the maximum amount of moisture absorption of the second moisture absorbing material 42 is greater than the maximum amount of moisture absorption of the first moisture absorbing material 41, as compared with a case in which the maximum amount of moisture absorption of the second moisture absorbing material 42 is smaller than the maximum amount of moisture absorption of the first moisture absorbing material 41, the amount of moisture moving from the first moisture absorbing material 41 to the second moisture absorbing material 42 increases so that the second moisture absorbing material 42 is likely to absorb moisture of the first moisture absorbing material 41. As a result, when the first moisture absorbing material 41 absorbs moisture and the moisture absorbing property of the first moisture absorbing material 41 decreases, in a case in which the second moisture absorbing material 42 is likely to absorb moisture of the first moisture absorbing material 41, it is possible to reliably recover the moisture absorbing property of the first moisture absorbing material 41 and to reliably enhance the moisture absorbing capacity of the first moisture absorbing material 41.

Therefore, it is preferable that the maximum amount of moisture absorption of the second moisture absorbing material 42 is greater than the maximum amount of moisture absorption of the first moisture absorbing material 41.

Furthermore, in the packing body 50, since the third space R3 where the second moisture absorbing material 42 is disposed is wider than the second space R2 where the first moisture absorbing material 41 is disposed, as compared with a case in which the third space R3 is narrower than the second space R2 where the first moisture absorbing material 41 is disposed, a larger amount of the second moisture absorbing material 42 is disposed in the third space R3, and the maximum amount of moisture absorption of the second moisture absorbing material 42 is increased. Therefore, the second moisture absorbing material 42 can be further likely to absorb moisture of the first moisture absorbing material 41.

In addition, it is desirable that the maximum amount of moisture absorption of the second moisture absorbing material 42 is greater than the amount of test solution remaining in the liquid ejecting head 20. In a step of discharging the test solution, the amount of the test solution remaining in the liquid ejecting head 20 can be easily obtained experimentally from a difference between the weight of the liquid ejecting head 20 before filling the test solution and the weight of the liquid ejecting head 20 after filling and discharging the test solution. The amount of the second moisture absorbing material 42 is set so that the maximum amount of moisture absorption of the second moisture absorbing material 42 is greater than the remaining amount of the test solution. Therefore, it is possible to reliably recover the moisture absorption performance of the first moisture absorbing material 41 even when all the test solution evaporates due to long term storage. In addition, the amount of the second moisture absorbing material 42 is set so that the maximum amount of moisture absorption of the second moisture absorbing material 42 is greater than the sum of the volumes in the flow path of the liquid ejecting head 20. Therefore, it is unnecessary to necessarily perform the discharging operation of the test solution, which is more desirable.

Method of Manufacturing Packing Body

Figure 6:
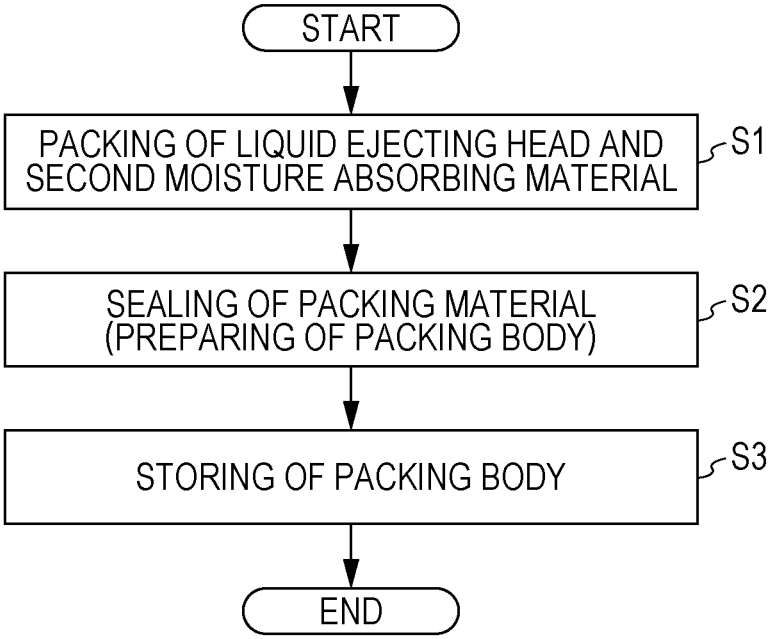
FIG. 6 is a flowchart illustrating a method of manufacturing the packing body according to the embodiment.
Figure 7:
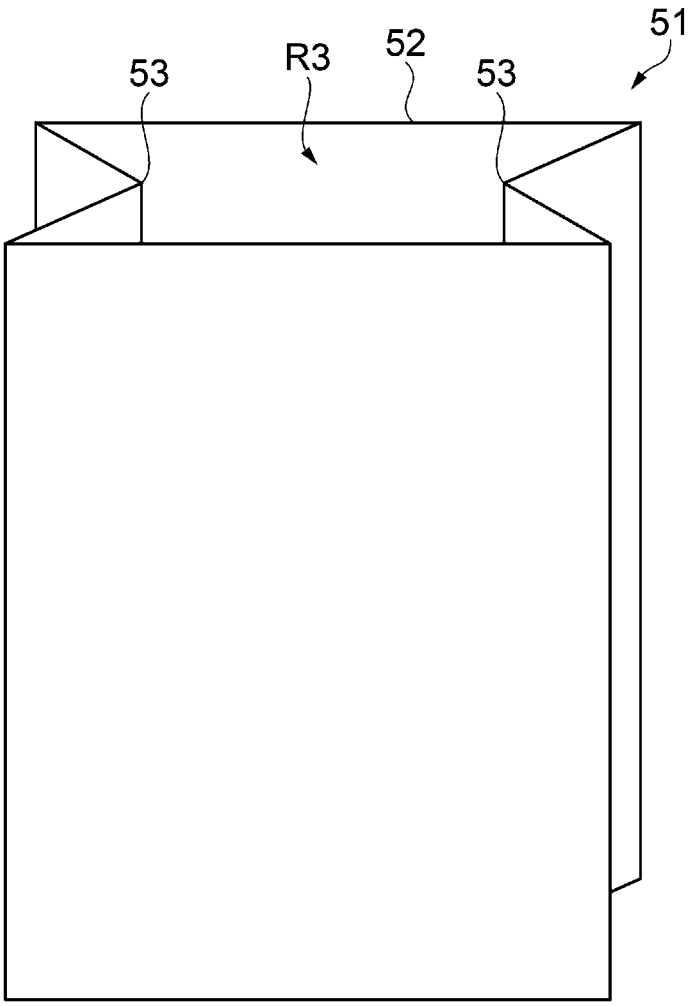
FIG. 7 is a perspective view of a packing material.

FIG. 6 is a flowchart illustrating a method of manufacturing the packing body according to the embodiment. FIG. 7 is a perspective view of a packing material.

Next, with reference to FIG. 6, a method of manufacturing the packing body 50 according to the embodiment will be described.

As illustrated in FIG. 6, the method of manufacturing the packing body 50 according to the embodiment includes a step of packing the liquid ejecting head 20 and the second moisture absorbing material 42 with the packing material 51 (Step S1), a step of sealing the packing material 51 to prepare the packing body 50 (Step S2), and a step of storing the packing body 50 for a predetermined time (Step S3).

Step S1 is an example of "first step", Step S2 is an example of "second step", and Step S3 is an example of "third step".

As illustrated in FIG. 7, the packing material 51 is a gusset bag having an opening 52 provided at one end and a fold 53 provided on a side surface. The packing material 51 is formed of a vapor-deposited metal film on which a metal such as aluminum is vapor-deposited, and has the moisture-proof property. A space in the packing material 51 is the third space R3.

In Step S1, the liquid ejecting head 20 and the second moisture absorbing material 42 are carried into the packing material 51 from the opening 52 of the packing material 51, and the liquid ejecting head 20 and the second moisture absorbing material 42 are disposed in the third space R3.

In other words, Step S1 is a step of disposing the liquid ejecting head 20 in which the first moisture absorbing material 41 and the electronic components (piezoelectric element 74 and circuit substrate 34) are disposed in the second space R2 formed by a case member 30, and the second moisture absorbing material 42 having the higher moisture absorbing property than that of the first moisture absorbing material 41 in the third space R3 formed by the packing material 51 having the moisture-proof property in a state where the second space R2 and the third space R3 are communicated with each other.

In Step S2, the opening 52 of the packing material 51 is sealed, for example, by heat sealing to prepare the packing body 50 illustrated in FIG. 4. Since the packing material 51 has the moisture-proof property, when the opening 52 of the packing material 51 is sealed, the third space R3 is unlikely to be affected by external moisture and becomes the sealed space isolated from the outside moisture. Therefore, in the packing body 50, the liquid ejecting head 20 and the second moisture absorbing material 42 having the higher moisture absorbing property than that of the first moisture absorbing material 41 are placed in the sealed space isolated from the outside moisture.

Furthermore, in the liquid ejecting head 20, the first moisture absorbing material 41 and the electronic components (piezoelectric element 74 and circuit substrate 34) are disposed in the second space R2 communicating with the third space R3 via the atmosphere communication port 32. Therefore, in the packing body 50, the first moisture absorbing material 41, the electronic components (piezoelectric element 74 and circuit substrate 34), and the second moisture absorbing material 42 are disposed in the sealed space isolated from the outside moisture.

In the packing body 50 prepared in Step S2, the second moisture absorbing material 42 is disposed so that the maximum amount of moisture absorption of the second moisture absorbing material 42 is greater than the maximum amount of moisture absorption of the first moisture absorbing material 41. As a result, in the next step (Step S3), the second moisture absorbing material 42 is likely to absorb moisture of the first moisture absorbing material 41 to reliably recover the moisture absorbing property of the first moisture absorbing material 41, so that the moisture absorption capability of the first moisture absorbing material 41 can be reliably enhanced.

In Step S3, the packing body 50 is stored for a predetermined time. In the packing body 50, the first moisture absorbing material 41, the second moisture absorbing material 42 having the higher moisture absorbing property than that of the first moisture absorbing material 41, and the electronic components (piezoelectric element 74 and circuit substrate 34) are disposed in the sealed space isolated from the outside moisture. Therefore, when the first moisture absorbing material 41 absorbs moisture and the moisture absorbing property of the first moisture absorbing material 41 decreases, moisture is moved from the first moisture absorbing material 41 to the second moisture absorbing material 42 to recover the moisture absorbing property of the first moisture absorbing material 41, so that the moisture absorbing capacity of the first moisture absorbing material 41 can be enhanced.

In this manner, Step S3 is a step of storing the packing body 50 for a predetermined time, and when the first moisture absorbing material 41 absorbs moisture and the moisture absorbing property of the first moisture absorbing material 41 decreases, a step of recovering the moisture absorbing property of the first moisture absorbing material 41 to enhance the moisture absorbing capacity of the first moisture absorbing material 41.

Method of Manufacturing Liquid Ejecting Apparatus

Figure 8:
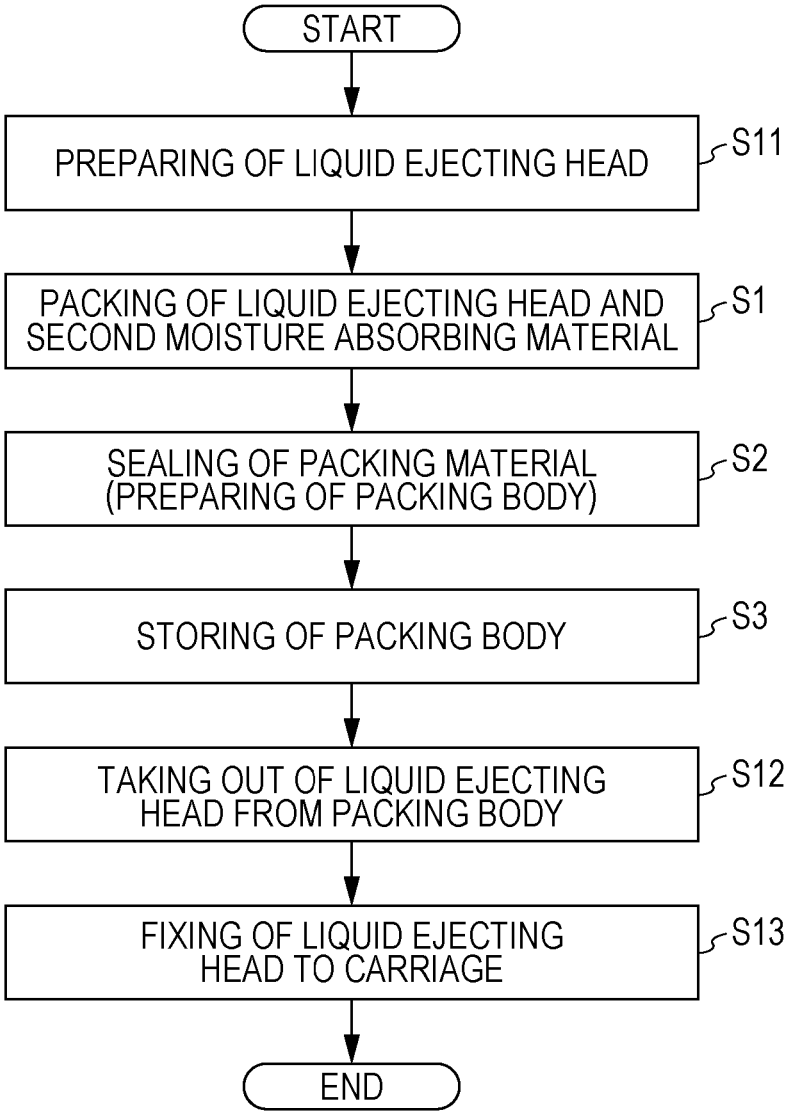
FIG. 8 is a flowchart illustrating a method of manufacturing the liquid ejecting apparatus according to the embodiment.

FIG. 8 is a flowchart illustrating a method of manufacturing the liquid ejecting apparatus according to the embodiment.

Next, with reference to FIG. 8, the method of manufacturing the liquid ejecting apparatus 10 according to the embodiment will be described.

As illustrated in FIG. 8, the method of manufacturing the liquid ejecting apparatus 10 according to the embodiment includes a step of preparing the liquid ejecting head 20 (Step S11), a step of packing the liquid ejecting head 20 and the second moisture absorbing material 42 with the packing material 51 (Step S1), a step of sealing the packing material 51 to prepare the packing body 50 (Step S2), a step of storing the packing body 50 for a predetermined time (Step S3), a step of taking out the liquid ejecting head 20 from the packing body 50 (Step S12), and a step of fixing the liquid ejecting head 20 to the carriage 18 (Step S13).

Step S1 in FIG. 8 is the same as Step S1 in FIG. 6, and Step S2 in FIG. 8 is the same as Step S2 in FIG. 6, Step S3 in FIG. 8 is the same as Step S3 in FIG. 6, and a detailed description thereof will be omitted.

In Step S11, a vibration plate 73 formed of a thermal oxide film (silicon oxide) and zirconium oxide is formed on the silicon substrate, and subsequently, the piezoelectric element 74 including the first electrode 742, the piezoelectric body 744, and the second electrode 746 is formed on the vibration plate 73. Subsequently, an opening portion 722 is formed on the silicon substrate by a known technique (for example, anisotropic etching), and the pressure chamber substrate 72 provided with the piezoelectric element 74 is prepared. Furthermore, an opening portion 712, a branch flow path 714, and a communication flow path 716 are formed on the silicon substrate by a known technique, and the flow path substrate 71 is prepared. Furthermore, a nozzle plate 76 is prepared by forming a nozzle N on the silicon substrate by a known technique. Furthermore, by a resin molding, a support body 75 provided with an accommodating portion 752 and an introduction flow path 754, and a sealing body 78 provided with a recessed portion 782 and a communication hole 784 are prepared. Furthermore, a pressure chamber substrate 72 on which the nozzle plate 76, the flow path substrate 71, and the piezoelectric element 74 are provided, and the support body 75 are joined to each other with an adhesive to prepare the liquid ejecting portion 70 illustrated in FIG. 3.

Subsequently, the case member 30 in which an opening portion 31, an atmosphere communication port 32, and a second space R2 are provided by resin molding, the first moisture absorbing material 41, and the circuit substrate 34 are prepared. The case member 30 and the liquid ejecting portion 70 are joined to each other with an adhesive in a state where the first moisture absorbing material 41 and the circuit substrate 34 are disposed in the second space R2 to prepare the liquid ejecting head 20 illustrated in FIG. 2.

Furthermore, in Step S11, after preparing the liquid ejecting head 20, the electronic components (piezoelectric element 74 and circuit substrate 34) of the liquid ejecting head 20 are driven, the ink is caused to flow in the flow path of the liquid ejecting head 20, and the ink is ejected from the nozzle N of the liquid ejecting head 20 to evaluate the performance of the liquid ejecting head 20. Subsequently, a cleaning liquid is caused to flow in the flow path of the liquid ejecting head 20, and the flow path of the liquid ejecting head 20 is cleaned with the cleaning liquid so that ink does not remain in the flow path of the liquid ejecting head 20. Subsequently, a gas (for example, nitrogen gas) is allowed to flow in the flow path of the liquid ejecting head 20, and the cleaning liquid is discharged from the flow path of the liquid ejecting head 20.

The ink is a water-based ink containing a solvent (water), coloring material (pigment, dye, and the like) and the like, and the cleaning liquid is a solution containing water as a main component.

In Step S1, the liquid ejecting head 20 determined as a good product by the performance evaluation in Step S11 and the second moisture absorbing material 42 are disposed in the third space R3 formed by the packing material 51.

In Step S2, the packing body 50 in which the first moisture absorbing material 41, the electronic components (piezoelectric element 74 and circuit substrate 34), and the second moisture absorbing material 42 are disposed in the sealed space isolated from the outside moisture is prepared.

In Step S3, the packing body 50 is stored for a predetermined time. That is, in Step S3, a predetermined time is set for moving the moisture from the first moisture absorbing material 41 to the second moisture absorbing material 42 before the step of taking out the liquid ejecting head 20 from the packing body 50 (Step S12). As a result, when the first moisture absorbing material 41 absorbs moisture and the moisture absorbing property of the first moisture absorbing material 41 decreases, moisture moves from the first moisture absorbing material 41 to the second moisture absorbing material 42, and the moisture absorbing property of the first moisture absorbing material 41 is recovered, so that the moisture absorbing capacity of the first moisture absorbing material 41 is enhanced.

In Step S12, the packing body 50 is opened, and the liquid ejecting head 20 is taken out from the packing body 50. Since the moisture absorbing capacity of the first moisture absorbing material 41 is enhanced in the previous step (Step S3), the moisture (water) entering the first space R1 via the communication hole 784 is absorbed by the first moisture absorbing material 41 to protect the electronic components (piezoelectric element 74 and circuit substrate 34) and the vibration plate 73 of the liquid ejecting head 20 from moisture, and the adverse effect (for example, corrosion or strength reduction due to long-term exposure to humid environment) of moisture (water) can be suppressed.

In Step S13, the liquid ejecting head 20 taken out from the packing body 50 kept for a predetermined time is fixed to the carriage 18, and the liquid ejecting apparatus 10 illustrated in FIG. 1 is manufactured.

For example, when the liquid ejecting apparatus 10 is carried from the manufacturing factory to the customer in a state where the liquid ejecting head 20 is mounted, in the step of preparing the liquid ejecting head 20 or a case of transporting the liquid ejecting apparatus 10 to the customer, the liquid ejecting apparatus 10 is delivered to the customer in a state where the first moisture absorbing material 41 absorbs moisture and the moisture absorbing property of the first moisture absorbing material 41 is decreased. As a result, the liquid ejecting head 20 is likely to be affected by moisture (water), and there is a possibility that a problem of shortening the life of the liquid ejecting head 20 may occur.

When the liquid ejecting apparatus 10 in which the liquid ejecting head 20 is not mounted and the packing body 50 in which the liquid ejecting head 20 is stored are carried from the manufacturing factory to the customer, the liquid ejecting head 20 is taken out from the packing body 50, and the customer fixes the liquid ejecting head 20 to the carriage 18 to manufacture the liquid ejecting apparatus 10, the liquid ejecting apparatus 10 is delivered to the customer in a state where the moisture absorbing capacity of the first moisture absorbing material 41 is enhanced. Therefore, the liquid ejecting head 20 is protected from moisture (water), so that the problem of shortening the life of the liquid ejecting head 20 can be prevented and the reliability of the liquid ejecting head 20 can be enhanced.

Therefore, when the liquid ejecting apparatus 10 without the liquid ejecting head 20 and the packing body 50 in which the liquid ejecting head 20 is stored are carried from the manufacturing factory to the customer and the customer performs Step S13 at the customer, the reliability of the liquid ejecting apparatus 10 delivered to the customer can be enhanced.

As a matter of course, at the manufacturing factory, the liquid ejecting head 20 taken out from the packing body 50 kept for a predetermined time may be fixed to the carriage 18 to manufacture the liquid ejecting apparatus 10 and the completed liquid ejecting apparatus 10 may be delivered to the customer.

Meanwhile, in the performance evaluation of the liquid ejecting head 20 in Step S11, gas is caused to flow in the flow path of the liquid ejecting head 20, and the cleaning liquid (water) is discharged from the flow path of the liquid ejecting head 20. However, since the flow path of the liquid ejecting portion 70 is intricately complicated, it is difficult to completely discharge moisture remaining in the flow path, and a small amount of moisture remains in the flow path of the liquid ejecting portion 70.

Therefore, in the step of preparing the liquid ejecting head 20 in Step S11, the first moisture absorbing material 41 absorbs moisture remaining in the flow path of the liquid ejecting portion 70 and there is a possibility that the moisture absorbing property of the first moisture absorbing material 41 decreases.

Furthermore, in the step of preparing the liquid ejecting head 20 of Step S11, when the case member 30 and the liquid ejecting portion 70 are joined to each other with an adhesive in a state where the first moisture absorbing material 41 and the circuit substrate 34 are disposed in the second space R2, the first moisture absorbing material 41 is exposed to the outside air. Therefore, the first moisture absorbing material 41 absorbs moisture contained in the outside air, and there is a possibility that the moisture absorbing property of the first moisture absorbing material 41 decreases.

In this manner, in the above-described Step S11, the first moisture absorbing material 41 absorbs moisture remaining in the flow path of the liquid ejecting portion 70 or moisture contained in the outside air, and there is a possibility that the moisture absorbing property of the first moisture absorbing material 41 decreases.

Figure 9:
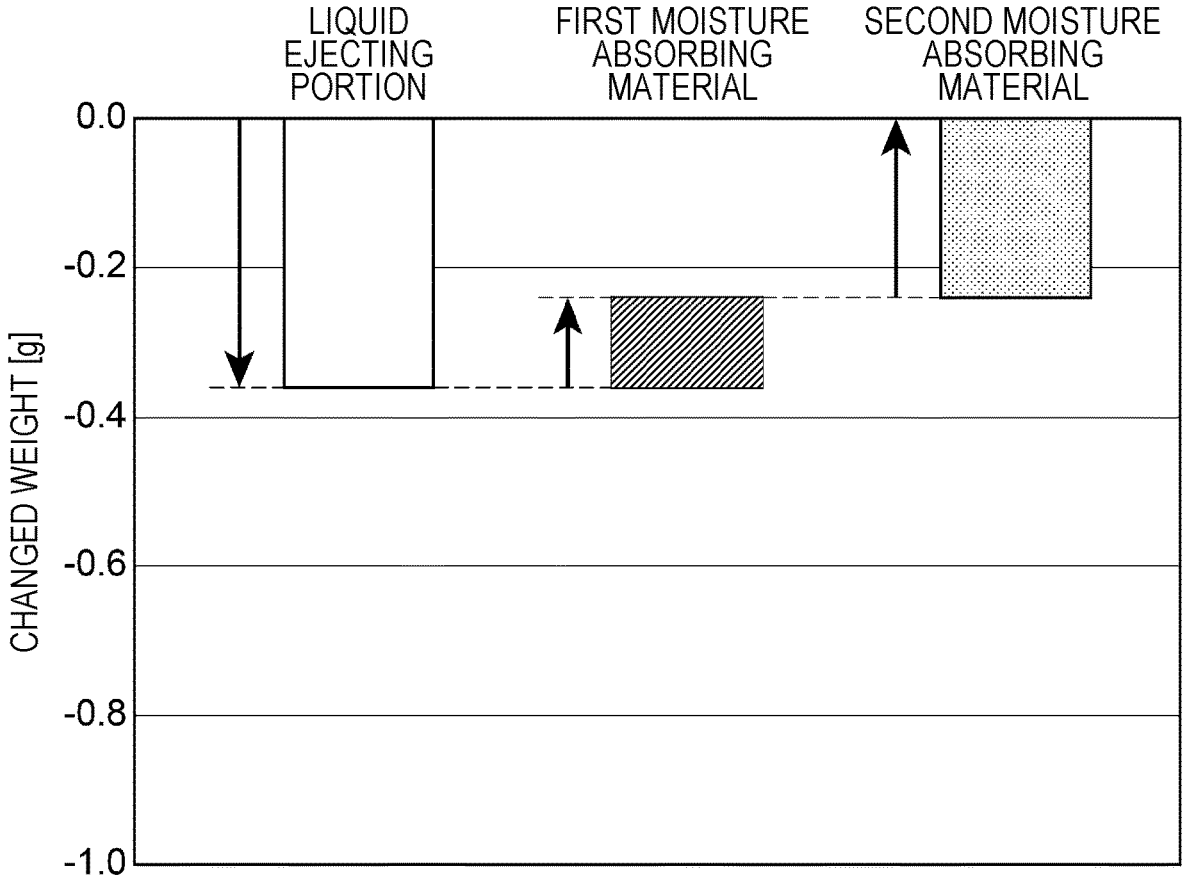
FIG. 9 is a graph illustrating a state of weight change of an object to be packed in the packing body when the packing body is stored in Step S3.
Figure 10:
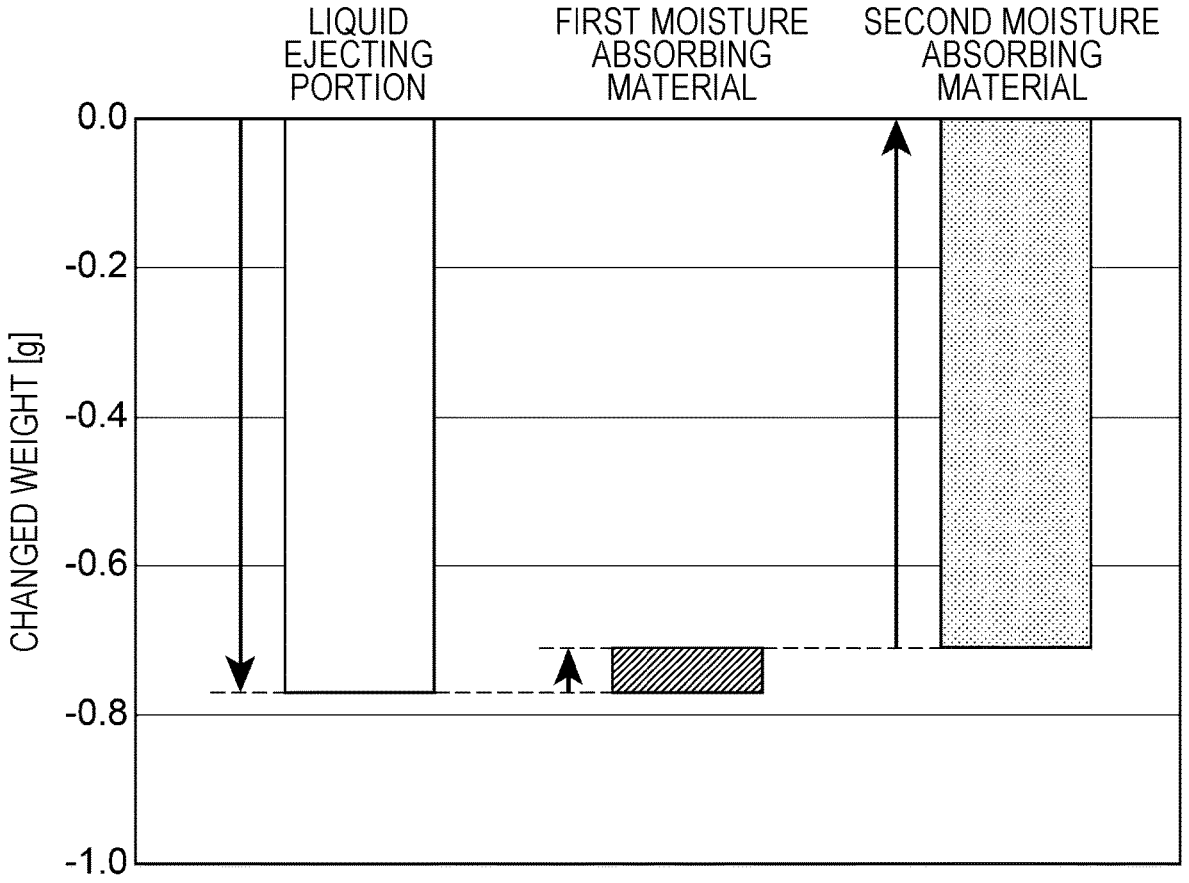
FIG. 10 is a graph illustrating a state of weight change of the object to be packed in the packing body when the packing body is stored in Step S3.

FIGS. 9 and 10 are graphs illustrating a state of weight change of an object to be packed (liquid ejecting portion 70, first moisture absorbing material 41, and second moisture absorbing material 42) in the packing body 50 when the packing body 50 is stored in Step S3.

In FIG. 9, when the packing body 50 is stored under the condition of 40° C. for 6 days, the weight change of the object to be packed (liquid ejecting portion 70, first moisture absorbing material 41, and second moisture absorbing material 42) in the packing body 50 is illustrated. In FIG. 10, in the context of an acceleration test of moisture evaporation from the liquid ejecting portion 70, when the packing body 50 is stored under the condition of 60° C. for 28 days, the weight change of the object to be packed (liquid ejecting portion 70, first moisture absorbing material 41, and second moisture absorbing material 42) in the packing body 50 is illustrated.

The arrows in FIGS. 9 and 10 illustrate the direction where the weight of the object to be packed (liquid ejecting portion 70, first moisture absorbing material 41, and second moisture absorbing material 42) inside the packing body 50 changes. Specifically, in FIGS. 9 and 10, when the packing body 50 is stored in Step S3, the weight of the liquid ejecting portion 70 changes in a decreasing direction and the weights of the first moisture absorbing material 41 and the second moisture absorbing material 42 change in increasing directions as illustrated by arrows in the figures.

As illustrated in FIG. 9, when the packing body 50 is stored under the condition of 40° C. for 6 days, the weight of the liquid ejecting portion 70 is decreased by approximately 0.36 g, the weight of the first moisture absorbing material 41 is increased by 0.12 g, the weight of the second moisture absorbing material 42 is increased by 0.24 g, and the weight decrease amount of the liquid ejecting portion 70 and the weight increase amount of the moisture absorbing materials 41 and 42 are the same as each other.

As illustrated in FIG. 10, when the packing body 50 is stored under the condition of 60° C. for 28 days, the weight of the liquid ejecting portion 70 is decreased by approximately 0.77 g, the weight of the first moisture absorbing material 41 is increased by 0.06 g, the weight of the second moisture absorbing material 42 is increased by 0.71 g, and the weight decrease amount of the liquid ejecting portion 70 and the weight increase amount of the moisture absorbing materials 41 and 42 are the same as each other.

In this manner, when the first moisture absorbing material 41, the liquid ejecting portion 70, and the second moisture absorbing material 42 are disposed in the sealed space isolated from the outside moisture, moisture remaining in the flow path of the liquid ejecting portion 70 is lost from the liquid ejecting portion 70 and absorbed by either the first moisture absorbing material 41 or the second moisture absorbing material 42. That is, when the packing body 50 is stored under the condition that moisture remains in the flow path of the liquid ejecting portion 70 and is kept at 40° C. for 6 days or at 60° C. for 28 days, moisture remaining in the flow path of the liquid ejecting portion 70 moves to either the first moisture absorbing material 41 or the second moisture absorbing material 42.

The first moisture absorbing material 41 is the physical adsorption-type moisture absorbing material, and the second moisture absorbing material 42 is the chemical reaction-type moisture absorbing material. Since a surface area of the first moisture absorbing material 41 is larger than a surface area of the second moisture absorbing material 42, in the initial stage where the moisture absorbing materials 41 and 42 absorb moisture, the first moisture absorbing material 41 absorbs moisture earlier than the second moisture absorbing material 42. Furthermore, since the first moisture absorbing material 41 is disposed near the liquid ejecting portion 70 as compared with the second moisture absorbing material 42, moisture evaporated from the flow path of the liquid ejecting portion 70 is likely to be absorbed.

Therefore, although the second moisture absorbing material 42 has the higher moisture absorbing property (moisture absorbing capacity) than that of the first moisture absorbing material 41, the first moisture absorbing material 41 absorbs a certain amount of moisture (0.12 g of moisture) under the condition of 40° C. for 6 days illustrated in FIG. 9. That is, in the initial stage of Step S3 (when storage time is as short as 6 days), the first moisture absorbing material 41 absorbs moisture remaining in the flow path of the liquid ejecting portion 70 and the moisture absorbing property of the first moisture absorbing material 41 decreases.

The second moisture absorbing material 42 has the higher moisture absorbing property than that of the first moisture absorbing material 41 and is likely to absorb moisture. Therefore, in the packing body 50 in which the first moisture absorbing material 41, the liquid ejecting portion 70, and the second moisture absorbing material 42 are disposed in the sealed space isolated from the outside moisture, a phenomenon occurs in which moisture moves from the first moisture absorbing material 41 to the second moisture absorbing material 42.

Therefore, due to the phenomenon that moisture moves from the first moisture absorbing material 41 to the second moisture absorbing material 42, it is considered that the weight increase amount (0.06 g) of the first moisture absorbing material 41 under the condition of 60° C. for 28 days illustrated in FIG. 10 is smaller than the weight increase amount (0.12 g) of the first moisture absorbing material 41 under the condition of 40° C. for 6 days illustrated in FIG. 9. That is, in the packing body 50, it is considered that most of the moisture in the liquid ejecting portion 70 moves to the first moisture absorbing material 41, and when the packing body 50 is stored for a long period of time, moisture moved to the first moisture absorbing material 41 moves from the first moisture absorbing material 41 to the second moisture absorbing material 42.

Furthermore, in the initial stage of Step S3 (for example, when storage time is as short as 6 days), even when the first moisture absorbing material 41 absorbs moisture remaining in the flow path of the liquid ejecting portion 70 and the moisture absorbing property of the first moisture absorbing material 41 decreases, in a case in which the storage time in Step S3 is lengthened, due to the phenomenon that moisture moves from the first moisture absorbing material 41 to the second moisture absorbing material 42, moisture from the first moisture absorbing material 41 is released to recover the moisture absorbing property of the first moisture absorbing material 41, so that the moisture absorbing capacity of the first moisture absorbing material 41 can be enhanced.

In addition, the weight decrease amount (0.36 g) of the liquid ejecting portion 70 under the condition of 40° C. for 6 days illustrated in FIG. 9 is smaller than the weight decrease amount (0.77 g) of the liquid ejecting portion 70 under the condition of 60° C. for 28 days illustrated in FIG. 10. Therefore, it is considered that moisture remaining in the flow path of the liquid ejecting portion 70 is not completely eliminated and remains in the flow path of the liquid ejecting portion 70 under the condition of 40° C. for 6 days.

According to the investigation of the inventor, under the condition of 60° C., when the storage time is 28 days or more, the weight decrease amount of the liquid ejecting portion 70 is substantially constant. Therefore, it is considered that moisture remaining in the flow path of the liquid ejecting portion 70 is completely eliminated under the condition of 60° C. for 28 days.

Moisture absorbed by the first moisture absorbing material 41 includes moisture that is absorbed by exposure to the outside air (moisture contained in outside air) in Step S11 in addition to moisture remaining in the flow path of the liquid ejecting portion 70. That is, the first moisture absorbing material 41 absorbs moisture remaining in the flow path of the liquid ejecting portion 70 and moisture contained in the outside air.

When Steps S1 to S3 are performed, the moisture absorbed by the first moisture absorbing material 41 (moisture remaining in flow path of liquid ejecting portion 70 and moisture contained in outside air) is released from the first moisture absorbing material 41 and moved to the second moisture absorbing material 42 to recover the moisture absorbing property of the first moisture absorbing material 41, so that the moisture absorbing capacity of the first moisture absorbing material 41 can be enhanced.

Therefore, in the performance evaluation of the liquid ejecting head 20 in Step S11 and in the step of preparing the liquid ejecting head 20 in Step S11, even when the first moisture absorbing material 41 absorbs moisture remaining in the flow path of the liquid ejecting portion 70 or moisture contained in the outside air, and the moisture absorbing property of the first moisture absorbing material 41 decreases, in a case in which Steps S1 to S3 are performed, moisture is released from the first moisture absorbing material 41 to recover the moisture absorbing property of the first moisture absorbing material 41, so that the moisture absorbing capacity of the first moisture absorbing material 41 can be enhanced.

The "predetermined time" in the present application is a time required to move the moisture from the first moisture absorbing material 41 to the second moisture absorbing material 42 when the first moisture absorbing material 41 absorbs moisture remaining in the flow path of the liquid ejecting portion 70 or moisture contained in the outside air in Step S3. Therefore, when the packing body 50 is stored at "Step S3" for "predetermined time" or more, in a case in which the first moisture absorbing material 41 absorbs moisture remaining in the flow path of the liquid ejecting portion 70 and moisture contained in the outside air, the moisture is moved from the first moisture absorbing material 41 to the second moisture absorbing material 42 to release moisture from the first moisture absorbing material 41 and to recover the moisture absorbing property of the first moisture absorbing material 41, so that the moisture absorbing capacity of the first moisture absorbing material 41 can be enhanced.

The "predetermined time" in the present application may be changed depending on the state of the flow path of the liquid ejecting portion 70, the type and amount of the moisture absorbing materials 41 and 42 used, the storage temperature, and the like.

In the embodiment, in Step S3, when the first moisture absorbing material 41 absorbs moisture remaining in the flow path of the liquid ejecting portion 70 and moisture contained in the outside air, the storage time required to move the moisture from the first moisture absorbing material 41 to the second moisture absorbing material 42 was approximately 1 to 3 months.

In addition, the second moisture absorbing material 42 plays a role of absorbing moisture remaining in the flow path of the liquid ejecting portion 70 in addition to a role of releasing the moisture from the first moisture absorbing material 41 to enhance the moisture absorbing capacity of the first moisture absorbing material 41.

Therefore, it is preferable that the maximum amount of moisture absorption of the second moisture absorbing material 42 is greater than the amount of the cleaning liquid (water) remaining in the liquid ejecting head 20 in the performance evaluation of the liquid ejecting head 20 in Step S11.

Embodiment 2

Figure 11:
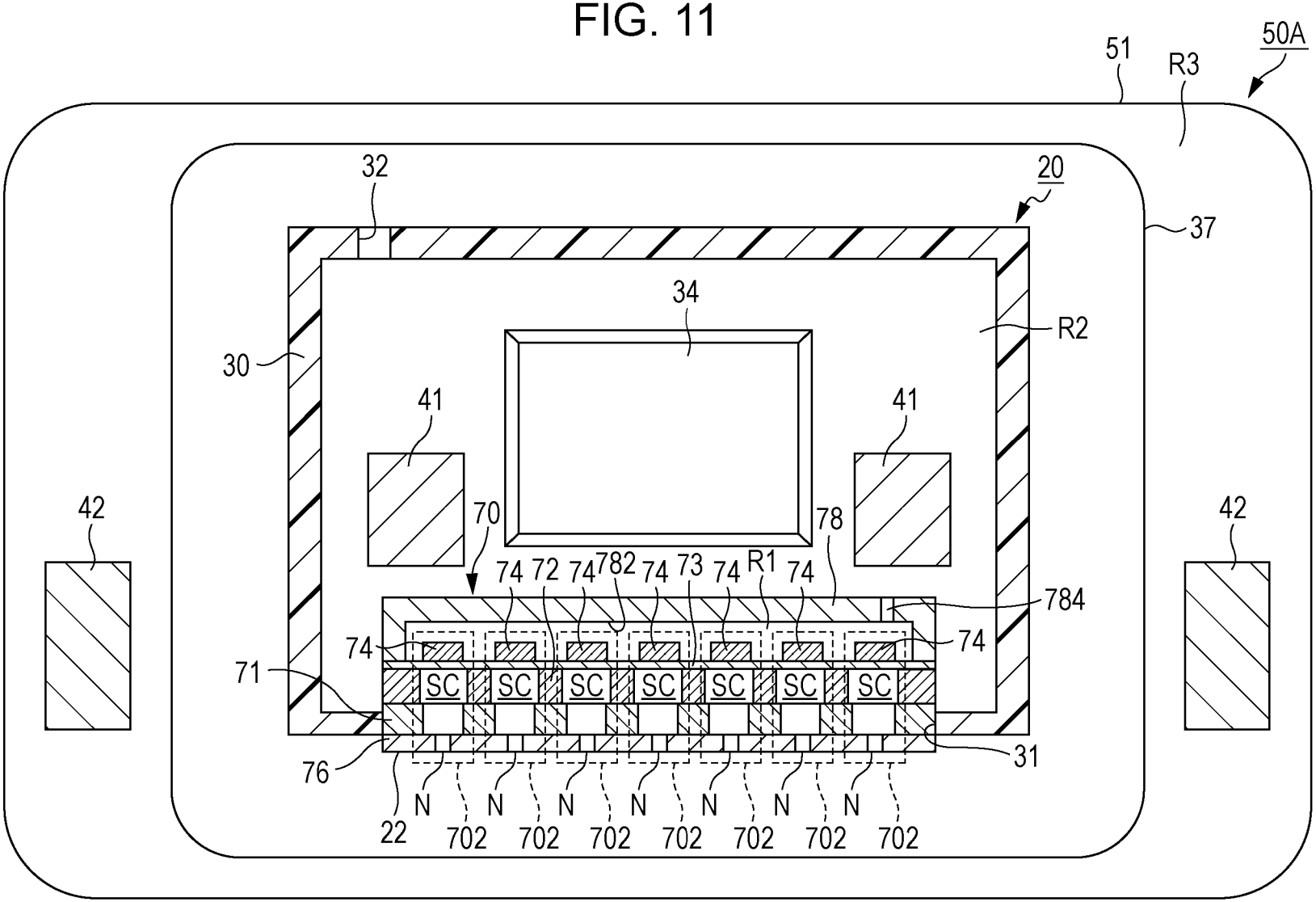
FIG. 11 is a schematic cross-sectional view of a packing body according to Embodiment 2.

FIG. 11 is a view corresponding to FIG. 4, and is a schematic cross-sectional view of a packing body according to Embodiment 2.

In the packing body 50A according to the present embodiment, the liquid ejecting head 20 is accommodated in the second case member 37. This point is the main difference between the present embodiment and the first embodiment.

Hereinafter, with reference to FIG. 11, the outline of the packing body 50A according to the present embodiment will be described focusing on the difference from the first embodiment. In addition, the same components as those in the first embodiment are denoted by the same reference numerals, and redundant explanations are omitted.

As illustrated in FIG. 11, the packing body 50A according to the present embodiment includes the packing material 51 forming the third space R3, the second case member 37, the liquid ejecting head 20, and the second moisture absorbing material 42. On the other hand, the packing body 50 according to Embodiment 1 includes the packing material 51 forming the third space R3, the liquid ejecting head 20, and the second moisture absorbing material (refer to FIG. 4). That is, the packing body 50A according to the present embodiment has a configuration in which the second case member 37 is added to the packing body 50 according to Embodiment 1.

The second case member 37 is an example of a "case".

The second case member 37 is disposed between the second space R2 and the third space R3. The second case member 37 is made of a moisture permeable material (for example, resin) and has the moisture permeability. Therefore, even when the second case member 37 is disposed between the second space R2 and the third space R3, moisture can move between the third space R3 and the second space R2. That is, even when the second case member 37 is disposed between the second space R2 and the third space R3, a packing space (third space R3) and an accommodating space (second space R2) are maintained in a state of being in communication with each other.

In the packing body 50A according to the present embodiment, the liquid ejecting head 20 is accommodated in the second case member 37 having moisture permeability and is protected by the second case member 37.

The second moisture absorbing material 42 is disposed outside the second case member 37 and the liquid ejecting head 20 is disposed inside the second case member 37. Therefore, in the second moisture absorbing material 42, even when the film having the moisture permeability and containing calcium oxide is damaged and calcium oxide flows out from the film, the liquid ejecting head 20 is protected by the second case member 37. Therefore, calcium oxide flowing out from the film does not contaminate the liquid ejecting head 20.

Therefore, it is possible to suppress the problem that the calcium oxide adheres to the liquid ejecting head 20 and the constituent elements of the liquid ejecting head 20 (for example, piezoelectric element 74 and circuit substrate 34) are corroded by the flowing out calcium oxide. That is, in addition to the effect obtained in Embodiment 1, it is possible to prevent the problem that the second moisture absorbing material 42 (calcium oxide) contaminates the liquid ejecting head 20 and the liquid ejecting head 20 deteriorates.

The present disclosure is not limited to the above-described embodiment, and can be appropriately changed within a scope not contrary to the gist or idea of the disclosure which can be read from the claims and the entire specification, and various modification examples other than the above embodiment are conceivable. Hereinafter, modification examples will be described.

Modification Example 1

In the above-described embodiment, the piezoelectric type liquid ejecting head 20 using the piezoelectric element 74 that applies mechanical vibration to the pressure chamber SC is exemplified, and a thermal type liquid ejecting head using a heating element for generating bubbles inside the pressure chamber by heating or a thermal head can be adopted.

For example, when the first moisture absorbing material 41 is disposed on the thermal type liquid ejecting head, the thermal type liquid ejecting head having the first moisture absorbing material 41, and the second moisture absorbing material 42 are disposed in the sealed space isolated from the outside moisture, and moisture is moved from the first moisture absorbing material 41 to the second moisture absorbing material 42 to enhance the moisture absorbing capacity of the first moisture absorbing material 41, by the first moisture absorbing material 41 having enhanced moisture absorption capability, it is possible to protect the electronic components (for example, circuit substrate and electrode) in the thermal type liquid ejecting head from moisture and to enhance the reliability of the thermal type liquid ejecting head.

For example, when the first moisture absorbing material 41 is disposed on the thermal head, the thermal head having the first moisture absorbing material 41, and the second moisture absorbing material 42 are disposed in the sealed space isolated from the outside moisture, and moisture is moved from the first moisture absorbing material 41 to the second moisture absorbing material 42 to enhance the moisture absorbing capacity of the first moisture absorbing material 41, by the first moisture absorbing material 41 having enhanced moisture absorption capability, it is possible to protect the electronic components (for example, circuit substrate and electrode) in the thermal head from moisture and to enhance the reliability of the thermal head.

Furthermore, the present application may be applied to an electronic device other than the liquid ejecting head 20, the thermal type liquid ejecting head, and the thermal head.

That is, when the first moisture absorbing material 41 is disposed on the electronic device, the electronic device having the first moisture absorbing material 41, and the second moisture absorbing material 42 are disposed in the sealed space isolated from the outside moisture, and moisture is moved from the first moisture absorbing material 41 to the second moisture absorbing material 42 to enhance the moisture absorbing capacity of the first moisture absorbing material 41, by the first moisture absorbing material 41 having enhanced moisture absorption capability, the electronic components (for example, circuit substrate and electrode) in the electronic device can be protected from moisture and the reliability of the electronic device can be enhanced.

Modification Example 2

The liquid ejecting apparatus 10 exemplified in the above-described embodiment can be adopted for various apparatuses such as a facsimile apparatus and a copying machine in addition to the apparatus dedicated for printing. Furthermore, the application of the liquid ejecting apparatus 10 of the present application is not limited to printing. For example, the liquid ejecting apparatus that ejects a solution of a coloring material is used as a manufacturing apparatus for forming a color filter, an organic electro luminescence (EL) display, a field emission display (FED), and the like of a liquid crystal display apparatus. In addition, the liquid ejecting apparatus for ejecting a solution of a conductive material is used as a manufacturing apparatus for forming a wiring and an electrode of a wiring substrate. In addition, it is also used as a chip manufacturing apparatus for ejecting a solution of bioorganic matter as a type of liquid.

Hereinafter, the contents derived from the above-described embodiment will be described.

The packing body of the present application includes a packing material that has a moisture-proof property and forms a packing space, a liquid ejecting head that includes a space forming member which forms an accommodating space communicating with the packing space, and a first moisture absorbing material and an electronic component which are disposed in the accommodating space, and is disposed in the packing space, and a second moisture absorbing material that has a higher moisture absorbing property than that of the first moisture absorbing material and is disposed in the packing space.

In the packing body, the liquid ejecting head (first moisture absorbing material and electronic component) and the second moisture absorbing material are disposed in the packing space formed by the packing material having the moisture-proof property. That is, the first moisture absorbing material, the electronic component, and the second moisture absorbing material are disposed in the sealed space isolated from the outside moisture.

Since the second moisture absorbing material has the higher moisture absorbing property than that of the first moisture absorbing material, when moisture remains in the electronic component, moisture remaining in the electronic component is likely to be absorbed by the second moisture absorbing material than the first moisture absorbing material. Therefore, the phenomenon that the first moisture absorbing material absorbs the moisture remaining in the electronic component and the moisture absorbing property of the first moisture absorbing material is unlikely to occur.

Furthermore, when the first moisture absorbing material absorbs moisture and the moisture absorbing property of the first moisture absorbing material is decreased, in a case in which the first moisture absorbing material and the second moisture absorbing material are sealed in the sealed space isolated from the outside moisture, moisture can be moved from the first moisture absorbing material to the second moisture absorbing material and the moisture absorbing property of the first moisture absorbing material can be recovered.

In the packing body of the present application, the space forming member may include an atmosphere communication port that allows the accommodating space and the packing space to communicate with each other, and the electronic component may be a piezoelectric element.

When the atmosphere communication port communicating the accommodating space and the packing space is provided, moisture (water) is likely to flow between the accommodating space in which the first moisture absorbing material and the electronic component are disposed and the packing space in which the second moisture absorbing material is disposed. As a result, the second moisture absorbing material is likely to absorb moisture remaining in the electronic component and moisture of the first moisture absorbing material.

Furthermore, even when the piezoelectric element is made of a material easily deteriorated by moisture, the piezoelectric element is disposed in a low humidity environment where moisture is low, so that the piezoelectric element can be protected from moisture and deterioration of the piezoelectric element can be prevented.

In the packing body of the present application, the first moisture absorbing material may be a physical adsorption-type moisture absorbing material.

In the physical adsorption-type moisture absorbing material, adsorption of moisture and release of moisture are performed reversibly. For example, in a high humidity environment, the physical adsorption-type moisture absorbing material absorbs moisture, and in a low humidity environment, the physical adsorption-type moisture absorbing material releases moisture.

As a result, when the first moisture absorbing material and the second moisture absorbing material are disposed in the sealed space isolated from the outside moisture, and the second moisture absorbing material has the higher moisture absorbing property than that of the first moisture absorbing material, a low humidity environment is created by the second moisture absorbing material, moisture is released from the first moisture absorbing material, so that the moisture absorbing capacity of the first moisture absorbing material can be enhanced.

In the packing body of the present application, the second moisture absorbing material may be a chemical reaction-type moisture absorbing material.

The chemical reaction-type moisture absorbing material has the higher moisture absorbing property than that of the physical adsorption-type moisture absorbing material. Therefore, when the second moisture absorbing material is the chemical reaction-type moisture absorbing material, as compared with a case in which the second moisture absorbing material is the physical adsorption-type moisture absorbing material, it is possible to decrease the humidity of the sealed space in which the first moisture absorbing material, the electronic component, and the second moisture absorbing material are disposed. As a result, moisture is likely to be released from the first moisture absorbing material.

In the packing body of the present application, a maximum amount of moisture absorption of the second moisture absorbing material may be greater than a maximum amount of moisture absorption of the first moisture absorbing material.

When the first moisture absorbing material and the second moisture absorbing material are disposed in the sealed space isolated from the outside moisture, and the maximum amount of moisture absorption of the second moisture absorbing material is greater than the maximum amount of moisture absorption of the first moisture absorbing material, as compared with a case where the maximum amount of moisture absorption of the second moisture absorbing material is smaller than the maximum amount of moisture absorption of the first moisture absorbing material, the second moisture absorbing material is likely to absorb moisture of the first moisture absorbing material.

In the packing body of the present application, the liquid ejecting head may be accommodated in a case having moisture permeability.

Since the liquid ejecting head is disposed in the case and the second moisture absorbing material is disposed outside the case, the second moisture absorbing material is unlikely to contaminate the liquid ejecting head.

The method of manufacturing a packing body of the present application includes disposing a liquid ejecting head in which a first moisture absorbing material and an electronic component are disposed in an accommodating space formed by a space forming member, and a second moisture absorbing material having the higher moisture absorbing property than that of the first moisture absorbing material in a packing space formed by a packing material having a moisture-proof property in a state where the accommodating space and the packing space communicate with each other, and sealing the packing material.

By the method of manufacturing the packing body of the present application, it is possible to manufacture the packing body in which the first moisture absorbing material, the electronic component, and the second moisture absorbing material are disposed in the sealed space isolated from the outside moisture. The second moisture absorbing material absorbs moisture remaining in the electronic component and moisture of the first moisture absorbing material, and can enhance the moisture absorbing capacity of the first moisture absorbing material.

In the method of manufacturing the packing body of the present application, a maximum amount of moisture absorption of the second moisture absorbing material may be greater than a maximum amount of moisture absorption of the first moisture absorbing material.

When the first moisture absorbing material and the second moisture absorbing material are disposed in the sealed space isolated from the outside moisture, and the maximum amount of moisture absorption of the second moisture absorbing material is greater than the maximum amount of moisture absorption of the first moisture absorbing material, as compared with a case where the maximum amount of moisture absorption of the second moisture absorbing material is smaller than the maximum amount of moisture absorption of the first moisture absorbing material, the second moisture absorbing material is likely to absorb moisture of the first moisture absorbing material.

The method of manufacturing the packing body of the present application may further include storing the packing body for a predetermined time after the sealing.

If the packing body in which the first moisture absorbing material, the electronic component, and the second moisture absorbing material are disposed in the sealed space isolated from the outside moisture is stored for a predetermined time, the second moisture absorbing material reliably absorbs the moisture remaining in the electronic component and the moisture of the first moisture absorbing material, so that the moisture absorbing capacity of the first moisture absorbing material can be reliably enhanced.

The method of manufacturing a liquid ejecting apparatus of the present application using a liquid ejecting head disposed in a packing space formed by a packing body having a moisture-proof property, in which the liquid ejecting head includes a space forming member which forms an accommodating space communicating with the packing space, and a first moisture absorbing material and an electronic component which are disposed in the accommodating space, and the liquid ejecting head and a second moisture absorbing material that has the higher moisture absorbing property than that of the first moisture absorbing material are disposed in the packing space, the method includes taking out the liquid ejecting head from the packing body, and fixing the liquid ejecting head to a carriage provided in the liquid ejecting apparatus.

In the packing body, the first moisture absorbing material and the second moisture absorbing material are disposed in the sealed space isolated from the outside moisture, and the second moisture absorbing material absorbs moisture remaining in the electronic component and moisture of the first moisture absorbing material, so that the moisture absorbing capacity of the first moisture absorbing material is enhanced.

For example, when the test solution used for inspecting the performance of the liquid ejecting head remains in the liquid flow path, the first moisture absorbing material absorbs the moisture of the test solution, and the moisture absorbing property of the first moisture absorbing material is decreased, the second moisture absorbing material absorbs the moisture of the first moisture absorbing material to recover the moisture absorbing property of the first moisture absorbing material, so that the moisture absorbing capacity of the first moisture absorbing material can be enhanced.

For example, when the first moisture absorbing material is exposed to the outside air in the process of manufacturing the liquid ejecting head, the first moisture absorbing material absorbs water (moisture) of the outside air, and the moisture absorbing property of the first moisture absorbing material is decreased, the second moisture absorbing material absorbs the moisture of the first moisture absorbing material to recover the moisture absorbing property of the first moisture absorbing material, so that the moisture absorbing capacity of the first moisture absorbing material can be enhanced.

Therefore, in the liquid ejecting head taken out from the packing body, since the moisture absorbing capacity of the first moisture absorbing material is enhanced, as compared with a case where the moisture absorbing capacity of the first moisture absorbing material is weak, the first moisture absorbing material stably prevents an increase in the humidity of the space in which the piezoelectric element is accommodated, and the piezoelectric element is unlikely to be deteriorated by moisture. That is, the reliability of the liquid ejecting head can be enhanced. In addition, reliability of the liquid ejecting apparatus in which the liquid ejecting head whose reliability is enhanced is fixed to the carriage is also enhanced.

In the method of manufacturing the liquid ejecting apparatus of the present application, a predetermined time for moving moisture from the first moisture absorbing material to the second moisture absorbing material may be provided before the taking out of the liquid ejecting head from the packing body.

When the packing body is stored for a predetermined time before taking out the liquid ejecting head from the packing body, the second moisture absorbing material reliably absorbs the moisture of the first moisture absorbing material and the piezoelectric element is unlikely to be deteriorated by moisture, so that the moisture absorbing capacity of the first moisture absorbing material can be enhanced.

As a result, in the liquid ejecting head taken out from the packing body, the first moisture absorbing material prevents an increase in the humidity of the space in which the piezoelectric element is accommodated, so that the reliability of the liquid ejecting head can be enhanced.

What is claimed is:

1. A packing body comprising:

a packing material that has a moisture-proof property and forms a packing space;

a liquid ejecting head that includes a space forming member which forms an accommodating space communicating with the packing space, and a first moisture absorbing material and a piezoelectric element which are disposed in the accommodating space, and a pressure chamber for accommodating a liquid, and a vibration plate which is disposed between the piezoelectric element and the pressure chamber, and a nozzle which communicates with the pressure chamber, and is disposed in the packing space; and a second moisture absorbing material that has a higher moisture absorbing property than that of the first moisture absorbing material and is disposed in the packing space, wherein the space forming member defines an atmosphere communication port that allows the accommodating space and the packing space to communicate with each other while the packing space is sealed and opened.

2. The packing body according to claim 1, wherein the first moisture absorbing material is a physical adsorption-type moisture absorbing material.

3. The packing body according to claim 2, wherein the second moisture absorbing material is a chemical reaction-type moisture absorbing material.

4. The packing body according to claim 1, wherein a maximum amount of moisture absorption of the second moisture absorbing material is greater than a maximum amount of moisture absorption of the first moisture absorbing material.

5. The packing body according to claim 1, wherein the liquid ejecting head is accommodated in a case having moisture permeability.

6. The packing body according to claim 1, wherein the packing space is wider than the accommodating space such that an amount of the second moisture absorbing material is larger than an amount of the first moisture absorbing member.

* * * * *